US009956762B2

(12) United States Patent
Washio et al.

(10) Patent No.: US 9,956,762 B2
(45) Date of Patent: May 1, 2018

(54) RECORDING APPARATUS AND RECORDING METHOD

(71) Applicant: SEIKO EPSON CORPORATION, Tokyo (JP)

(72) Inventors: Yuichi Washio, Matsumoto (JP); Kazuyoshi Tanase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/334,435

(22) Filed: Oct. 26, 2016

(65) Prior Publication Data

US 2017/0120576 A1 May 4, 2017

(30) Foreign Application Priority Data

Oct. 30, 2015 (JP) ..... 2015-214556

(51) Int. Cl.
*B41J 2/21* (2006.01)
*B41J 2/045* (2006.01)
*B41J 25/00* (2006.01)

(52) U.S. Cl.
CPC ..... *B41J 2/04505* (2013.01); *B41J 2/04586* (2013.01); *B41J 2/2132* (2013.01); *B41J 2/2146* (2013.01); *B41J 25/001* (2013.01)

(58) Field of Classification Search
CPC .... B41J 2/2132; B41J 2/2146; B41J 2/04586; B41J 19/393; B41J 19/147
See application file for complete search history.

(56) References Cited

U.S. PATENT DOCUMENTS 4,739,415 A * 4/1988 Toyono ..... B41J 3/28 347/12
2012/0188564 A1 7/2012 Miura

FOREIGN PATENT DOCUMENTS

JP 2012-152957 A 8/2012
JP 2012210767 A * 11/2012

* cited by examiner

*Primary Examiner* — Sharon A Polk
(74) *Attorney, Agent, or Firm* — Workman Nydegger

(57) ABSTRACT

A full-overlap type recording apparatus includes a recording unit and a controller. In the recording unit, n pieces of recording heads are disposed in a main scanning direction, positions of the n pieces of recording heads are shifted from each other in a sub-scanning direction, and the n pieces of recording heads are disposed so as to form m sets in the sub-scanning direction. The controller determines a use head based on the image data, and the use head is a recording head used for forming dots on a recording medium. The controller determines the use head for all raster lines formed on the recording medium, so as to respectively use the n pieces of recording heads when the raster lines are formed.

6 Claims, 15 Drawing Sheets

FIG. 7

55

| | DISTANCE [mm] FROM UPPER END OF PRINT AREA | | USE HEAD NUMBER | | | | | | | |
|---|---|---|---|---|---|---|---|---|---|---|
| | START | END | 1 PATH | 2 PATH | 3 PATH | 4 PATH | 5 PATH | 6 PATH | 7 PATH | 8 PATH |
| A1 | 0.00 | 6.21 | #2 | #2 | #2 | #2 | #1 | #1 | #1 | #1 |
| A2 | 6.21 | 12.42 | #3 | #2 | #2 | #2 | #2 | #1 | #1 | #1 |
| A3 | 12.42 | 18.63 | #3 | #3 | #2 | #2 | #2 | #2 | #1 | #1 |
| ⋮ | 18.63 | 24.84 | #3 | #3 | #3 | #2 | #2 | #2 | #2 | #1 |
| | 24.84 | 31.04 | #3 | #3 | #3 | #3 | #2 | #2 | #2 | #2 |
| | 31.04 | 37.25 | #4 | #3 | #3 | #3 | #3 | #2 | #2 | #2 |
| | 37.25 | 43.46 | #4 | #4 | #3 | #3 | #3 | #3 | #2 | #2 |
| | 43.46 | 49.67 | #4 | #4 | #4 | #3 | #3 | #3 | #3 | #2 |
| | 49.67 | 55.88 | #4 | #4 | #4 | #4 | #3 | #3 | #3 | #3 |
| | 55.88 | 62.09 | #5 | #4 | #4 | #4 | #4 | #3 | #3 | #3 |
| | 62.09 | 68.30 | #5 | #5 | #4 | #4 | #4 | #4 | #3 | #3 |
| | 68.30 | 74.51 | #5 | #5 | #5 | #4 | #4 | #4 | #4 | #3 |
| | 74.51 | 80.72 | #5 | #5 | #5 | #5 | #4 | #4 | #4 | #4 |
| | 80.72 | 86.92 | #6 | #5 | #5 | #5 | #5 | #4 | #4 | #4 |
| | 86.92 | 93.13 | #6 | #6 | #5 | #5 | #5 | #5 | #4 | #4 |
| | 93.13 | 99.34 | #6 | #6 | #6 | #5 | #5 | #5 | #5 | #4 |
| | 99.34 | 105.55 | #6 | #6 | #6 | #6 | #5 | #5 | #5 | #5 |
| | 105.55 | 111.76 | #7 | #6 | #6 | #6 | #6 | #5 | #5 | #5 |
| | 111.76 | 117.97 | #7 | #7 | #6 | #6 | #6 | #6 | #5 | #5 |
| | 117.97 | 124.18 | #7 | #7 | #7 | #6 | #6 | #6 | #6 | #5 |
| | 124.18 | 130.39 | 0 | #7 | #7 | #7 | #6 | #6 | #6 | #6 |
| | 130.39 | 136.60 | #8 | #7 | #7 | #7 | #7 | #6 | #6 | #6 |
| | 136.60 | 142.80 | #8 | #8 | #7 | #7 | #7 | #7 | #6 | #6 |
| | 142.80 | 149.01 | #8 | #8 | #8 | #7 | #7 | #7 | #7 | #6 |
| | 149.01 | 152.22 | #8 | #8 | #8 | #8 | #7 | #7 | #7 | #7 |
| | 152.22 | 161.43 | #9 | #8 | #8 | #8 | #8 | #7 | #7 | #7 |
| | 161.43 | 167.64 | #9 | #9 | #8 | #8 | #8 | #8 | #7 | #7 |
| | 167.64 | 173.85 | #9 | #9 | #9 | #8 | #8 | #8 | #8 | #7 |
| | 173.85 | 180.06 | #9 | #9 | #9 | #9 | #8 | #8 | #8 | #8 |
| | 180.06 | 186.27 | #10 | #9 | #9 | #9 | #9 | #8 | #8 | #8 |
| | 186.27 | 192.48 | #10 | #10 | #9 | #9 | #9 | #9 | #8 | #8 |
| | 192.48 | 198.68 | #10 | #10 | #10 | #9 | #9 | #9 | #9 | #8 |
| | 198.68 | 204.89 | #10 | #10 | #10 | #10 | #9 | #9 | #9 | #9 |
| | 204.89 | 211.10 | #11 | #10 | #10 | #10 | #10 | #9 | #9 | #9 |
| | 211.10 | 217.31 | #11 | #11 | #10 | #10 | #10 | #10 | #9 | #9 |
| | 217.31 | 223.52 | #11 | #11 | #11 | #10 | #10 | #10 | #10 | #9 |
| | 223.52 | 229.73 | #11 | #11 | #11 | #11 | #10 | #10 | #10 | #10 |
| | 229.73 | 235.94 | #12 | #11 | #11 | #11 | #11 | #10 | #10 | #10 |
| | 235.94 | 242.15 | #12 | #12 | #11 | #11 | #11 | #11 | #10 | #10 |
| | 242.15 | 248.36 | #12 | #12 | #12 | #11 | #11 | #11 | #11 | #10 |
| | 248.36 | 254.56 | #12 | #12 | #12 | #12 | #11 | #11 | #11 | #11 |
| | 254.56 | 260.77 | #13 | #12 | #12 | #12 | #12 | #11 | #11 | #11 |
| | 260.77 | 266.98 | #13 | #13 | #12 | #12 | #12 | #12 | #11 | #11 |
| | 266.98 | 273.19 | #13 | #13 | #13 | #12 | #12 | #12 | #12 | #11 |
| | 273.19 | 279.40 | #13 | #13 | #13 | #13 | #12 | #12 | #12 | #12 |
| | 279.40 | 285.61 | #14 | #13 | #13 | #13 | #13 | #12 | #12 | #12 |
| | 285.61 | 291.82 | #14 | #14 | #13 | #13 | #13 | #13 | #12 | #12 |
| | 291.82 | 298.03 | #14 | #14 | #14 | #13 | #13 | #13 | #13 | #12 |
| ⋮ | 298.03 | 302.24 | #14 | #14 | #14 | #14 | #13 | #13 | #13 | #13 |
| | 302.24 | 310.44 | #15 | #14 | #14 | #14 | #14 | #13 | #13 | #13 |
| A51 | 310.44 | 316.65 | #15 | #15 | #14 | #14 | #14 | #14 | #13 | #13 |

FIG. 9

| | | | | | | |
|---|---|---|---|---|---|---|
| L1 | #2 | #1 | #2 | #1 | #2 | #1 |
| L2 | #1 | #2 | #1 | #2 | #1 | #2 |
| L3 | #3 | #2 | #3 | #2 | #3 | #2 |
| L4 | #1 | #2 | #1 | #2 | #1 | #2 |
| L5 | #2 | #1 | #2 | #1 | | |
| L6 | #1 | #2 | #1 | #2 | | |
| L7 | #3 | #2 | #3 | #2 | | |
| L8 | #1 | #2 | #1 | #2 | | |
| L9 | #2 | #1 | | | | |
| L10 | #1 | #2 | | | | |
| L11 | #3 | #2 | | | | |
| L12 | #1 | #2 | | | | |

. . .

. . .

RECORDING APPARATUS AND RECORDING METHOD

BACKGROUND

1. Technical Field

The present invention relates to a recording apparatus.

2. Related Art

A recording apparatus (so-called ink jet printer) which performs printing by ejecting an ink (droplet) onto a recording medium so as to form dots is known. Such a recording apparatus includes a recording unit and a recording head. The recording unit can relatively move a print medium in a main scanning direction and a sub-scanning direction. The recording head is attached to the recording unit. The recording head includes a plurality of nozzles. In the recording apparatus, an ink is ejected from each of the nozzles. JP-A-2012-152957 discloses a configuration in which a plurality of recording heads is disposed in zigzag in a recording unit in such a recording apparatus.

As a forming method of dots in the above-described recording apparatus, "a full-overlap method" in which, regarding all raster lines, dots on the same raster line are formed by multiple times of main scanning is known.

FIG. 1 illustrates an example of a recording unit U in which a plurality of recording heads Hd is disposed in zigzag. In FIG. 1, a main scanning direction of the recording unit is indicated by an arrow which is denoted by X, and a sub-scanning direction of the recording unit is indicated by an arrow which is denoted by Y. A direction perpendicular to both of the main scanning direction X and the sub-scanning direction Y is referred to as a depth direction Z. Among the plurality of recording heads Hd which are disposed in zigzag in the recording unit U, a set of recording heads Hd disposed on the right side (dot-hatching in FIG. 1) is referred to as a "right-side head", and a set of recording heads Hd disposed on the left side (slash-hatching in FIG. 1) is referred to as a "left-side head". In FIG. 1, the right-side head is indicated with being surrounded by a one-dot chain line, and the left-side head is indicated with being surrounded by a broken line.

FIG. 2 is a diagram illustrating a problem in the related art. In FIG. 2, each of dots formed on a recording medium by nozzles of the right-side head is presented by a thick-bordered circle, and each of dots formed on the recording medium by nozzles of the left-side head is presented by a thin-bordered circle. Each pixel which is formed on the recording medium by a dot when the recording unit U is moved forth in the main scanning direction X is presented by a hatched quadrangle. Each pixel which is formed on the recording medium by a dot when the recording unit U is moved back in the main scanning direction X is presented by a blank quadrangle.

As illustrated in FIG. 1, in a case where printing is performed with the recording unit U in which a plurality of recording heads Hd is disposed in zigzag, by using the above-described full-overlap method, the followings may be mixed on the recording medium.

First type of raster line (L1, L2, L3, L4, L5, and L7 in FIG. 2) in which both of dots formed by the nozzles of the right-side head and dots formed by the nozzles of the left-side head are included.

Second type of raster line (L6 and L8 in FIG. 2) in which only dots formed by the nozzles of either of the right-side head and the left-side head are included.

As illustrated in FIG. 1, the recording unit U may be inclined from the sub-scanning direction Y with a rotation axis as the center by various causes such as a manufacturing error or a use status, for example (that is, the recording unit U may be in a state where a nozzle line of the recording head Hd is not parallel to the sub-scanning direction Y). The rotation axis is parallel to the depth direction Z. In this manner, in a case where the recording unit U is inclined from the sub-scanning direction Y, a position of the right-side head in the recording unit U is uniformly shifted from a position of the left-side head to an upper side or a lower side of the sub-scanning direction Y, in comparison to a position of the right-side head in a case of being parallel.

In a case where printing by the above-described full-overlap method is performed by using the recording unit U which is in a state where the positions of the right and left heads are shifted from each other, a space between the first type of raster line and the second type of raster line becomes ununiform. For example, in the example of FIG. 2, a space IN4 between the first type of raster line L5 and the second type of raster line L6 is smaller than a space IN1 between first type of raster lines L1 and L2 or a space IN2 between first type of raster lines L2 and L3. Similarly, a space IN5 between the second type of raster line L6 and the first type of raster line L7 is larger than the space IN1 or IN2. As described above, Area 2 in which the spaces between the raster lines are not uniform is shown on the print medium, as a banding unevenness (band-like density unevenness). Thus, Area 2 is not preferable.

Such a problem commonly occurs in a case where two or more (for example, three) recording heads are disposed parallel to each other in the main scanning direction of the recording unit.

Thus, in a recording apparatus which performed printing with a recording unit in which a plurality of recording heads is disposed in zigzag, by using the full-overlap method, it is desirable that occurrence of the banding unevenness is suppressed.

SUMMARY

The invention can be realized as the following aspects.

(1) According to an aspect of the invention, there is provided a full-overlap type recording apparatus. The recording apparatus includes a recording unit which includes n pieces (n is a natural number of 2 or more) of recording heads which enable forming of dots on a recording medium and are disposed in a main scanning direction of the recording unit; the n pieces of recording heads being disposed so as to have positions shifted from each other in a sub-scanning direction of the recording unit; and the n pieces of recording heads being disposed so as to form m sets (m is a natural number of 1 or more) in the sub-scanning direction; a carriage that moves the recording units in the main scanning direction and the sub-scanning direction; and a controller that determines a use head based on image data, the use head being one of the recording heads, which is used for forming dots for one raster line on the recording medium. The controller determines the use head for all raster lines formed on the recording medium, so as to respectively use the n pieces of recording heads when the raster lines are formed.

According to the recording apparatus according to the aspect, regarding all dot lines (that is, raster lines) in the main scanning direction, which are formed on the recording medium, the n pieces of recording heads which are disposed in the recording unit so as to be parallel to the main scanning direction are respectively used, and thus the raster lines are formed. Accordingly, according to the recording apparatus according to the aspect, in the recording apparatus in which printing is performed by using the full-overlap method and by using the recording unit in which the plurality of recording heads is disposed in zigzag, it is possible to suppress the occurrence of the banding unevenness.

(2) In the recording apparatus according to the aspect, the recording unit may perform main scanning in which dots are formed on the recording medium with moving in the main scanning direction, on a print area M times (M is a natural number of 1 or more); and the controller may determine the use head so as to form dots which are adjacent to each other in each of the raster line by performing the main scanning for each of the number of times of k (k is natural number of 1 or more) which satisfies a relationship of k=M/n.

According to the recording apparatus according to the aspect, the controller can simply determine a use head by performing in accordance with the above rule.

(3) In the recording apparatus according to the aspect, in a case where a switching request is received from a user, the controller may determine the use head so as to form dots which are adjacent to each other in each of the raster lines by performing the main scanning for each of the number of times of k which satisfies the relationship; and in a case where the switching request is not received from the user, the controller may determine the use head without depending on the relationship.

According to the recording apparatus according to the aspect, the controller can change a determining method of the use head with the switching request from the user as a motivation, and thus it is possible to improve convenience for the user.

(4) In the recording apparatus according to the aspect, an inclination detector that detects an inclination of the recording unit may be further included; in a case where the inclination detector detects that the recording units are not parallel to the sub-scanning direction, the controller may determine the use head so as to form dots which are adjacent to each other in each of the raster lines by performing the main scanning for each of the number of times of k which satisfies the relationship; and in a case where the inclination detector does not detect that the recording units are not parallel to the sub-scanning direction, the controller may determine the use head without depending on the relationship.

According to the recording apparatus according to the aspect, the controller can change the determining method of the use head with occurrence of inclination from the main scanning direction of the recording unit, as a motivation, and thus it is possible to improve convenience for the user and to improve printed image quality.

(5) In the recording apparatus according to the aspect, each of the recording heads may include a plurality of nozzles which form dots by discharging droplets, and are disposed parallel to each other in the sub-scanning direction; the n pieces of recording heads may be disposed so as to overlap positions of some of the plurality of nozzles of the recording heads which are adjacent to each other, with each other in the sub-scanning direction; and the controller may determine the use head so as to respectively use the n pieces of recording heads, when the droplets are discharged from the nozzles of the recording heads, which are disposed at a portion at which the overlap occurs.

According to the recording apparatus according to the aspect, in a case where droplets are discharged from the nozzles of the recording heads, which are disposed at a portion at which the overlap occurs in the sub-scanning direction, all (n pieces) of the recording heads which are disposed in the recording unit so as to be parallel to the main scanning direction are respectively used, and thus the corresponding raster lines are formed. Thus, according to the recording apparatus of the aspect, in the recording apparatus in which printing is performed by using the full-overlap method and by using the recording unit in which the plurality of recording heads is disposed in zigzag, it is possible to suppress the occurrence of the banding unevenness.

All of a plurality of components which is included in each of the above-described aspects in the invention are not necessary provided. In order to solve a portion or the entirety of the above-described problem, or to achieve some or all of advantages described in this specification, some components of the plurality of components may be modified, removed, replaced with new components, and some of limited details may be deleted. In order to solve a portion or the entirety of the above-described problem, or to achieve some or all of advantages described in this specification, some or all of technical features included in one above-described aspect of the invention may be combined with some or all of technical features included in another above-described aspect of the invention, and the combination may be used as an independent aspect of the invention.

The invention may be realized as various forms. For example, the invention can be realized as a recording apparatus and a control method of the recording apparatus, a system including the recording apparatus, a computer program for realizing functions of the method, the apparatus, and the system, a device for distributing the computer program, a storage medium in which the computer program is stored, and the like.

BRIEF DESCRIPTION OF THE DRAWINGS

The invention will be described with reference to the accompanying drawings, wherein like numbers reference like elements.

FIG. 7 is a diagram illustrating an example of a correspondence table.

FIG. 9 is a diagram illustrating an example of use heads in an area determined by a full-overlap processing portion.

DESCRIPTION OF EXEMPLARY EMBODIMENTS

A. First Embodiment

A-1. Configuration of Printing System

Figure 3:
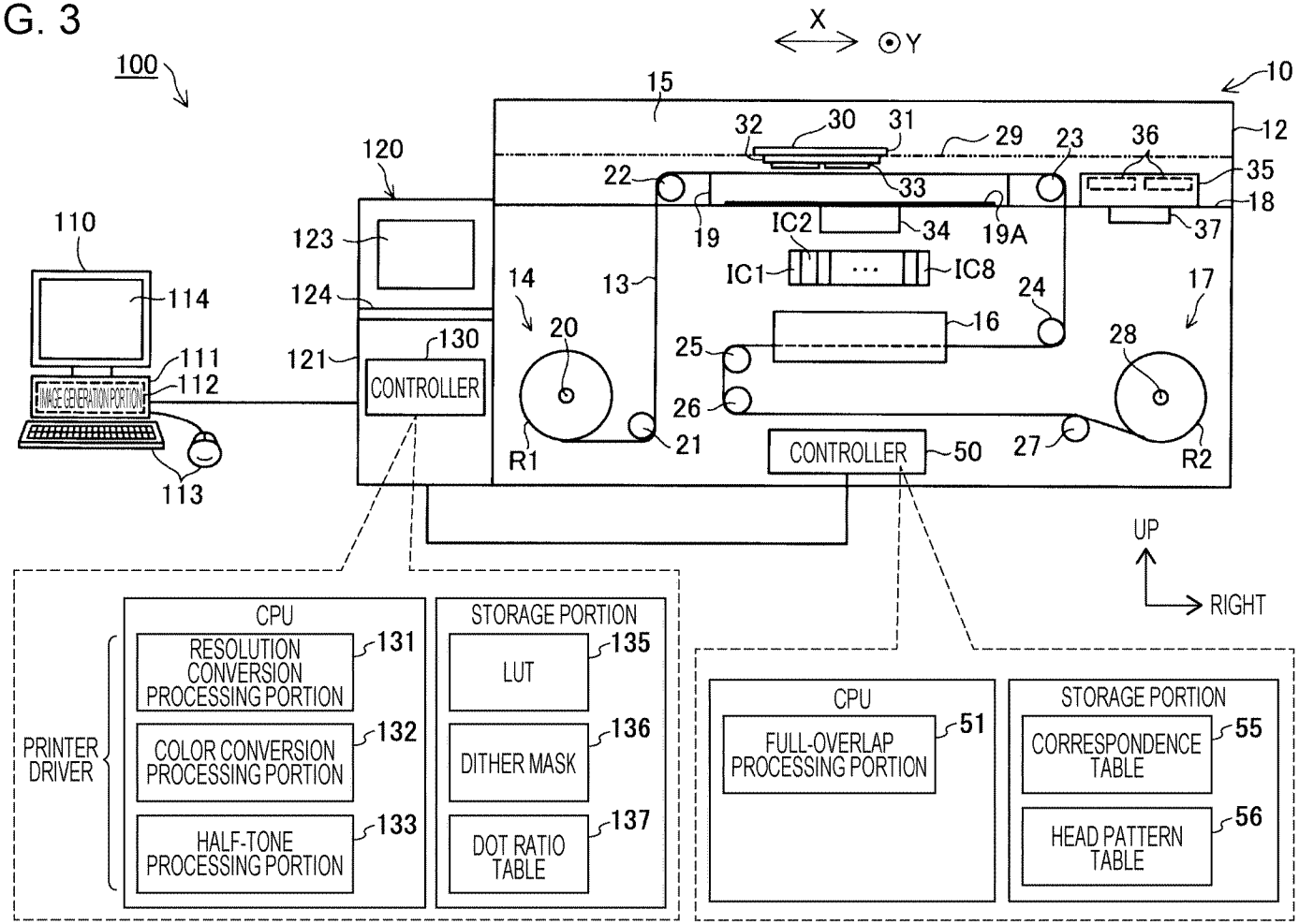
FIG. 3 is a schematic diagram illustrating a configuration of a printing system which includes a recording apparatus according to an embodiment of the invention.

FIG. 3 is a schematic diagram illustrating a configuration of a printing system which includes a recording apparatus according to an embodiment of the invention. A printing system 100 includes an image generation device 110, a host device 120, and a printer 10. In the embodiment, the host device 120 and the printer 10 are cooperated with each other, and thus function as "a recording apparatus". The recording apparatus (host device 120 and printer 10) in the embodiment has a configuration which will be described later, and thus suppresses occurrence of a banding unevenness on a recording medium.

The image generation device 110 generates image data and transmits the generated image data to the host device 120. The host device 120 generates print data based on the image data received from the image generation device 110, and transmits the generated print data to the printer 10. The printer 10 forms dots on a recording medium based on the print data received from the host device 120, so as to print an image indicating the image data.

The image generation device 110 is configured by, for example, a personal computer. The image generation device 110 includes a main body 111, an image generation portion 112, an input device 113, and a monitor 114. The main body 111 includes a storage portion and a CPU. The storage portion stores an image creation program. The input device 113 corresponds to an input device such as a keyboard or a mouse, for example. The monitor 114 corresponds to a display device such as a liquid crystal display, for example. The monitor 114 displays a graphical user interface (GUI) screen (menu screen and the like) for causing a user to operate the image generation device 110, or a GUI screen for causing a user to create or edit an image to be printed.

The image generation portion 112 is a functional portion realized by the CPU of the main body 111 executing the image creation program in the storage portion. The image generation portion 112 controls display of the GUI screen which is displayed in the monitor 114 and is used for creating or editing an image. Thus, a user starts the image generation portion 112 and operates the input device 113, and thus can create an image for printing through the GUI screen displayed in the monitor 114. For example, in a case where the image for printing is a label attached to a product, a user can create a plurality of frame images in which plural pieces of label images are disposed lengthwise and breadthwise. Then, the user performs an instruction of printing the plurality of created frame images, by using the input device 113. If the instruction is received, the image generation portion 112 transmits image data which indicates the plurality of created frame images, to the host device 120 through a communication interface. Instead of creation of an image, the image generation device 110 or the host device 120 may directly read image data stored in a storage medium.

The host device 120 is configured by, for example, a personal computer. The host device 120 includes a main body 121, a monitor 123, an operation portion 124, and a controller 130. The main body 121 is a housing for accommodating the components of the host device 120. The monitor 123 corresponds to a display device such as a liquid crystal display, for example. The monitor 123 displays a GUI screen (menu screen and the like) for causing a user to operate the host device 120, or a GUI screen for displaying an image to be printed.

The controller 130 includes a CPU and a storage portion. The CPU controls the component of the host device 120 (for example, controls display of the above-described GUI screen) by executing a computer program (not illustrated) in the storage portion, and functions as a resolution conversion processing portion 131, a color conversion processing portion 132, and a half-tone processing portion 133. The resolution conversion processing portion 131, the color conversion processing portion 132, and the half-tone processing portion 133 function as a printer driver in which print data is generated based on image data, and the generated print data is transmitted to the printer 10. The storage portion stores a look-up table (LUT) 135, a dither mask 136, and a dot ratio table 137 in advance. The look-up table 135 indicates a conversion correspondence relationship between a color system for display and a color system for printing. The dot ratio table 137 indicates a ratio of S dots, M dots, and L dots by the recording unit 30.

The resolution conversion processing portion 131 converts resolution of image data acquired from the image generation device 110 from display resolution to print resolution. The color conversion processing portion 132 performs color conversion from the color system for display (for example, RGB color system and YCbCr color system) to the color system for printing (for example, CMYK color system) by using the LUT 135. The half-tone processing portion 133 performs gradation conversion of pixel data for display, which has high gradation (for example, 256 gradations) into pixel data for printing, which has low gradation (for example, 4 gradations), based on a known systematic dither method by using the dither mask 136 and the dot ratio table 137. In the embodiment, the half-tone processing portion 133 generates pixel data having four gradations, that is, no dot formation, small (S) dot formation, medium (M) dot formation, and large (L) dot formation. The half-tone processing portion 133 may perform gradation conversion by using an error diffusion method and the like instead of the systematic dither method.

For example, an input of management information regarding a print target (for example, label attached to a product), setting of a print condition, and the like can be performed on the menu screen. The management information may include, for example, a product number of a product, a lot number, and distinguishment of front surface printing or rear surface printing in a case of double-sided printing. The print condition may include, for example, the type and the size of a print medium, print quality, and a version number. As the type of a print medium, paper formed from high-quality paper, cast paper, art paper, coated paper, and the like, and films formed from synthetic paper, PET, PP and the like are provided. As the size of a print medium, for example, in a case of the embodiment in which it is assumed that a roll obtained by winding a long print medium is used, the width of the roll is employed. As the print quality, plural types of predetermined print modes (print resolution or a recording method is determined in accordance with a print mode) are provided. Instead of the print mode, the print resolution or the recording method may be directly designated. Regarding the version number, in a case where a plurality of editions (images) is overlapped and printed on the same area of a print medium, the number of images functions as the version number. In a case where a plurality of editions is set, an image for each edition can be displayed in the monitor 123.

A-2. Configuration of Printer

The printer 10 according to the embodiment is a so-called ink jet printer that forms dots by using a full-overlap method. The printer 10 includes a main body case 12, a sending portion 14, a printing chamber 15, a drying device 16, a winding portion 17, a first roller 21 to a seventh roller 27, ink cartridges IC1 to IC8, and a controller 50. In the following descriptions, directions indicated by arrows in FIG. 3 are respectively referred to as "right and left" and "up and down" as references. The front side of the surface of paper in FIG. 3 is referred to as "front" and a depth side of the surface of the paper is referred to as "rear".

The main body case 12 is a housing which accommodates the components of the printer 10. The main body case 12 includes a flat base 18 which horizontally divides the inside of the housing.

The sending portion 14 feeds a sheet 13 which is an example of the recording medium. The sending portion 14 is disposed at a position on the lower left side of the base 18 in the main body case 12. The first roller 21 to the seventh roller 27 guide the sheet 13. The winding portion 17 winds the dried sheet 13. The winding portion 17 is disposed at a position on the lower right side of the base 18 in the main body case 12. That is, the sheet 13 in the printer 10 according to the embodiment is transported from the left side of the housing, on which the sending portion 14 is disposed, to the right side of the housing, on which the winding portion 17 is disposed. Thus, in the following descriptions, the left side of the housing, on which the sending portion 14 is also referred to as "an upstream side" in a transporting direction of the sheet 13, and the right side of the housing is also referred to as "a downstream side" in the transporting direction of the sheet 13.

In the printing chamber 15, an ink (droplet) is ejected to the sheet 13 which has been sent, so as to form a dot, and thus an image indicating image data is printed. The printing chamber 15 is disposed in an area of the main body case 12 on an upper side of the base 18. The printing chamber 15 includes a support stand 19. The support stand 19 has a rectangular plate shape and is used for supporting a print area of the sheet 13. The support stand 19 is disposed at a position which is substantially the center of the base 18, and is disposed in a state of being supported on the base 18. The drying device 16 is a drying furnace for drying a sheet 13 which has an ink adhering thereto. The drying device 16 is disposed above the sending portion 14 and the winding portion 17, between the sending portion 14 and the winding portion 17.

The sending portion 14 includes a winding shaft 20. The winding shaft 20 is a shaft which can be rotationally driven. A sheet 13 (also below referred to as "a roll R1") which is wound so as to have a roll shape is supported around the winding shaft 20, and thus the sheet 13 and the winding shaft 20 can be integrally rotated. That is, the winding shaft 20 is rotated, and thus the sheet 13 is sent from the roll R1.

The first roller 21 to the seventh roller 27 are shafts for guiding the sheet 13 which has been sent from the sending portion 14, to the winding portion 17 through the printing chamber 15 and the drying device 16. The first roller 21 is disposed on the right side of the sending portion 14. The second roller 22 is disposed on the left side of the support stand 19. The third roller 23 is disposed on the right side of the support stand 19. The fourth roller 24 is disposed on the right side of the drying device 16. The fifth roller 25 is disposed on the left side of the drying device 16. The sixth roller 26 is disposed on a lower side of the fifth roller 25. The seventh roller 27 is disposed on the left side of the winding portion 17. The sheet 13 which has been sent from the sending portion 14 is wound by the first roller 21, and thus the transporting direction of the sheet 13 is changed to a vertically upper side. Then, the sheet 13 is wound from the lower left side of the second roller 22, and thus the transporting direction thereof is changed to a horizontally right side. The sheet 13 slides on an upper surface of the support stand 19. The sheet 13 which has been transported from the upper surface of the support stand 19 to the right side thereof is wound from the upper right side of the third roller 23 by the third roller 23, and thus the transporting direction thereof is changed to a vertically lower side. Then, the sheet 13 is wound by the fourth roller 24, and thus the transporting direction thereof is changed to a horizontally left side. Thus, the sheet 13 passes through the drying device 16. The sheet 13 which has passed through the drying device 16 is wound from the upper left side of the fifth roller 25 by the fifth roller 25, and thus the transporting direction thereof is changed to the vertically lower side. Then, the sheet 13 is guided to the winding portion 17 by the sixth roller 26 and the seventh roller 27.

The winding portion 17 includes a winding shaft 28. The winding shaft 28 is a shaft which can be rotationally driven based on a driving force of a transporting motor (not illustrated). A sheet 13 (also below referred to as "a roll R2") which is wound so as to have a roll shape is held by the winding shaft 28. That is, the winding shaft 28 is rotated, and thus the sheet 13 is wound to the roll R2.

A die cutting machining device for performing die of a portion printed on a sheet 13 may be provided in the middle of the above-described transporting path of the sheet 13 (for example, between the drying device 16 and the winding portion 17).

The printing chamber 15 includes a guide rail 29 (two-dot chain line in FIG. 3) and the recording unit 30 which is an example of a recorder. The guide rail 29 is a pair of rails for guiding movement of the recording unit 30 in the main scanning direction thereof. The guide rail 29 is disposed so as to be extended in a right-and-left direction in the front side and the rear side of the support stand 19.

The recording unit 30 ejects an ink to a sheet 13. The recording unit 30 includes a rectangular carriage 31, a support plate 32, and a recording head 33 which is an example of a recording unit. The carriage 31 is supported in a state where the carriage 31 can move back and forth in the main scanning direction X (right-and-left direction in FIG. 3) along both of the guide rails 29, based on driving of a carriage motor. The carriage 31 is supported in a state where the carriage 31 can move back and forth in the sub-scanning direction Y (front-and-rear direction perpendicular to the surface of the paper in FIG. 3) along other guide rails (not illustrated). As a result, the recording unit 30 can be moved in two directions of the main scanning direction X and the sub-scanning direction Y. In the printer 10 according to the embodiment, a scanner is realized by using the guide rail 29, and a line feeder is realized by using the other guide rails. The support plate 32 is installed on the lower surface side of the carriage 31, and supports a plurality of recording heads 33. Detailed descriptions will be made later.

In the printing chamber 15, a predetermined range over almost the entire area of the upper surface of the support stand 19 functions as a print region. A sheet 13 is intermittently transported in a unit of a print area corresponding to the print region. A suction device 34 is further provided on the lower side of the support stand 19. The suction device 34 is driven so as to apply negative pressure to multiple suction holes (not illustrated) which opens to the upper surface of the support stand 19. The suction force occurring by the negative pressure causes the sheet 13 to be absorbed to the upper surface of the support stand 19. While the recording unit 30 moves in the main scanning direction X, main scanning and sub-scanning are alternately performed, and thus printing is performed on one print area of the sheet 13. In the main scanning, inks are ejected from the recording head 33. In the sub-scanning, the recording unit 30 is moved in the sub-scanning direction Y, and thus the recording unit 30 is caused to be disposed at the next main scanning position. If the printing on the one print area is ended, the negative pressure of the suction device 34 is released, and the absorption of the sheet 13 onto the support stand 19 is released. Then, the sheet 13 is transported, and a sheet 13 on which printing is not performed is disposed on the support stand 19. Thus, the print area on the sheet 13 is changed from one print area to the next print area. That is, in the printer 10 according to the embodiment, transporting of a sheet 13 causes the print area in the sheet 13 to be changed.

The ink cartridges IC1 to IC8 respectively accommodate inks (liquids) having different colors. The ink cartridges IC1 to IC8 are mounted in the housing of the main body case 12, so as to be attachable. In the printer 10 according to the embodiment, the ink cartridges IC1 to IC8 respectively accommodate inks of black (K), cyan (C), magenta (M), yellow (Y), white (W), and clear (transparent color for overcoating). The type of the ink or the number of colors may be appropriately set. A cartridge for accommodating a moisturizer for maintenance may be further provided in addition to inks for printing. Each of the ink cartridges IC1 to IC8 is connected to the recording head 33 through an ink supply passage (not illustrated). Each recording head 33 ejects an ink which has been supplied from each of the ink cartridges IC1 to IC8, to a sheet 13.

A maintenance device 35 is further disposed on the right end side in the printing chamber 15. The maintenance device 35 is used for performing maintenance of the recording heads 33 when printing is not performed. The maintenance device 35 includes a cap 36 and a lifting device 37. The recording head 33 of the recording unit 30 which waits at a home position when printing is not performed is capped with the cap 36 which is lifted up by driving of the lifting device 37. Thus, thickening the ink in a nozzle is prevented. If it is time to perform predetermined maintenance, a suction pump (not illustrated) of the maintenance device 35 is driven under a state of being capped, and thus the inside of the cap 36 has negative pressure. Thus, the ink is forcibly discharged from the nozzle of the recording head 33, and thus it is possible to remove a thickened ink in a nozzle or foam and the like.

A heater 19A is further provided on the lower surface of the support stand 19. The heater 19A heats the support stand 19 up to a predetermined temperature (for example, 40° C. to 60° C.). The sheet 13 is primarily dried on the support stand 19 by the heater 19A, and is secondarily dried by the drying device 16.

The controller 50 includes a CPU and a storage portion. A computer program (not illustrated) in the storage portion is executed, and thus the CPU controls the component of the printer and functions as a full-overlap processing portion 51. The storage portion stores a correspondence table 55 and a head pattern table 56 in advance. Detailed descriptions will be made later.

The full-overlap processing portion 51 determines the recording head 33 in the recording unit 30, which is used for forming a dot on a sheet 13, by full-overlap processing (which will be described later). In addition, the controller 50 controls a transporting operation, an absorption operation, a printing operation, and an absorption-release operation which are necessary for printing. The transporting operation is an operation in which a sheet 13 is transported by driving a transporting motor (not illustrated). The absorption operation is an operation in which the sheet 13 is absorbed to the upper surface of the support stand 19 by driving the suction device 34. The printing operation is an operation in which an ink in the recording head 33 is discharged. The absorption-release operation is an operation in which driving of the suction device 34 is released, and absorption of the sheet 13 to the support stand 19 is released.

A-3. Configuration of Recording Unit

Figure 4:
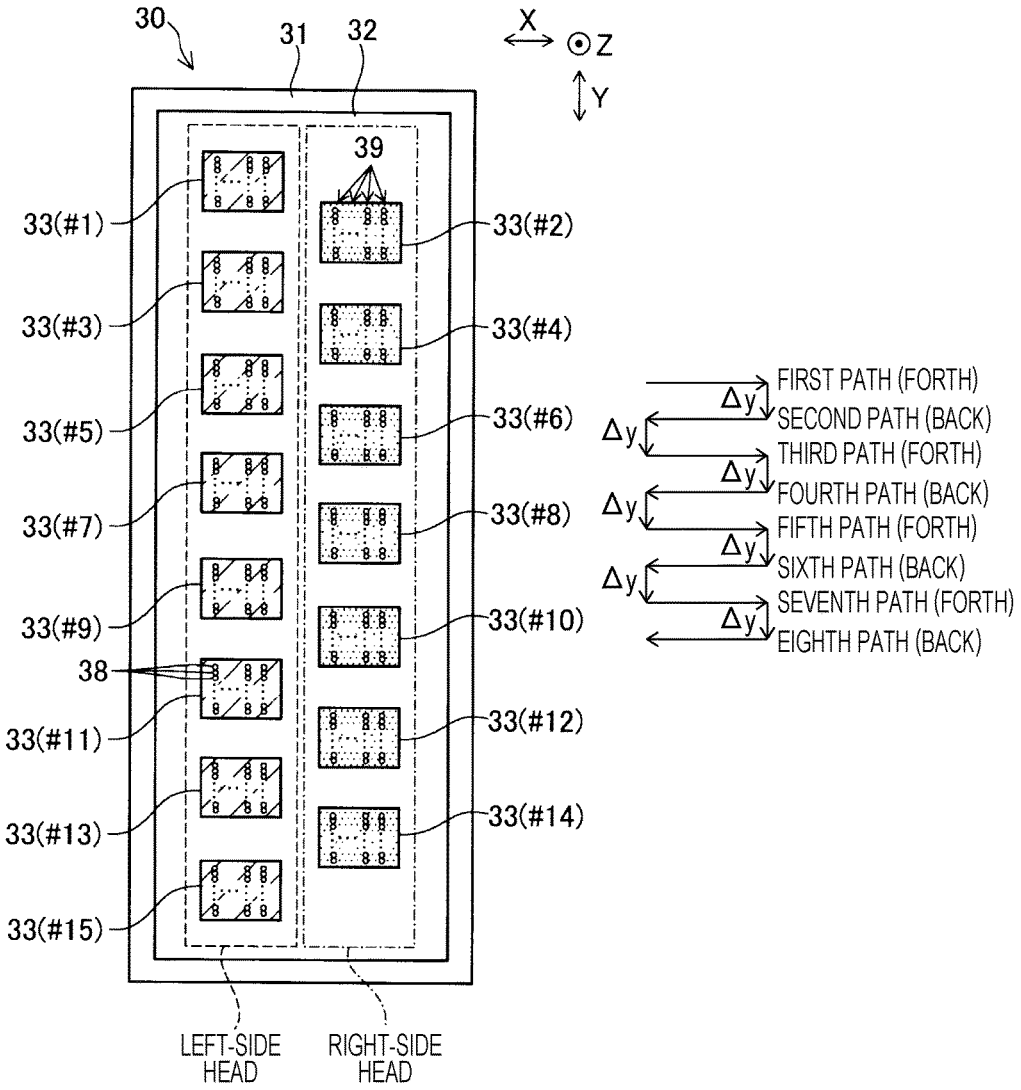
FIG. 4 is a diagram illustrating a configuration of the recording unit.

FIG. 4 is a diagram illustrating a configuration of the recording unit 30. FIG. 4 illustrates a configuration of the recording unit 30 on the bottom surface side (direction from a lower side toward an upper side in FIG. 3). In FIG. 4, an arrow denoted by X corresponds to the main scanning direction X (right-and-left direction in FIG. 3) of the recording unit 30. An arrow denoted by Y corresponds to the sub-scanning direction Y (front-and-rear direction perpendicular to the surface of the paper in FIG. 3) of the recording unit 30. A direction perpendicular to both of the main scanning direction X and the sub-scanning direction Y is referred to as a depth direction Z. In the following descriptions, the length of the recording unit 30 in the main scanning direction X is also referred to as the width of the recording unit 30". The length of the recording unit 30 in the sub-scanning direction Y is also referred to as the height of the recording unit 30".

The support plate 32 is supported on the bottom surface side (direction from the lower side toward the upper side in FIG. 3) of the carriage 31 which has been attached to the recording unit 30. P pieces (P is a natural number of 2 or more, and P is 15 in the embodiment) of recording heads 33 are supported by the support plate 32, so as to have a zigzag arrangement pattern in the main scanning direction X and the sub-scanning direction Y. In the following descriptions, in a case where descriptions will be made with distinguishing the recording heads 33 from each other, the recording heads 33 are also respectively referred to as a first head (#1 in FIG. 4), a second head (#2 in FIG. 4), . . . , and a fifteenth head (#15 in FIG. 4) in an order from an upper side (upper side in FIG. 4) of the sub-scanning direction Y.

"Zigzag" in the embodiment means a disposition which satisfies all of the following conditions a1 to a3.

(a1) n pieces (n is a natural number of 2 or more) of recording heads 33 are disposed in the main scanning direction X (that is, width direction of the recording unit 30).

(a2) The n pieces of recording heads 33 are disposed so as to have shifted positions in the sub-scanning direction Y (that is, height direction of the recording unit 30).

(a3) The n pieces of recording heads 33 are disposed in the sub-scanning direction Y, so as to form m sets (m is a natural number of 1 or more). Recording heads 33 of which the number is less than n, and which do not satisfy the condition a3 may be further disposed in the recording unit 30.

In the example in FIG. 4, two recording heads 33 (#1 and #2) are disposed in the main scanning direction X, and thus satisfy the condition a1. The two recording heads 33 (#1 and #2) disposed in the main scanning direction X have positions which are different from each other in the sub-scanning direction Y, and thus satisfy the condition a2. Two recording heads 33 disposed in the main scanning direction X are disposed so as to form one of 7 sets (#1 and #2, #3 and #4, #5 and #6, #7 and #8, #9 and #10, #11 and #12, and #13 and #14) in the sub-scanning direction Y, and thus satisfy the condition a3. That is, in the example in FIG. 4, n=2 and m=7 are set. In the example in FIG. 4, one recording head 33 (#15) which does not satisfy the condition a3 is further disposed in the recording unit 30. As a result, as described above, the recording heads of which the total number is 15 are disposed in the recording unit 30.

In the recording unit 30, among a plurality of recording heads 33 which are disposed in zigzag, a set of recording heads 33 which are disposed on the right side are referred to as "a right-side head", and a set of recording heads 33 which are disposed on the left side are referred to as "a left-side head". In FIG. 4, the right-side head is dot-hatched and has an attached frame of an one-dot chain line. The left-side head is slash-hatched and has an attached frame of a broken line.

A plurality of nozzle lines 39 (8 lines in the embodiment) are disposed on the bottom surface side (direction from the lower side toward the upper side in FIG. 3) of each of the recording heads 33. The nozzle lines 39 are disposed at a predetermined interval in the main scanning direction X. Each of the nozzle lines 39 includes a plurality of nozzles 38 which are arranged at a constant nozzle pitch along the sub-scanning direction Y. Each of the nozzle lines 39 receives a supply of an ink from the one corresponding ink cartridge among 8 ink cartridges IC1 to IC8. In each of the nozzle lines 39, the ink having a different type is ejected from the nozzle 38.

Figure 5:
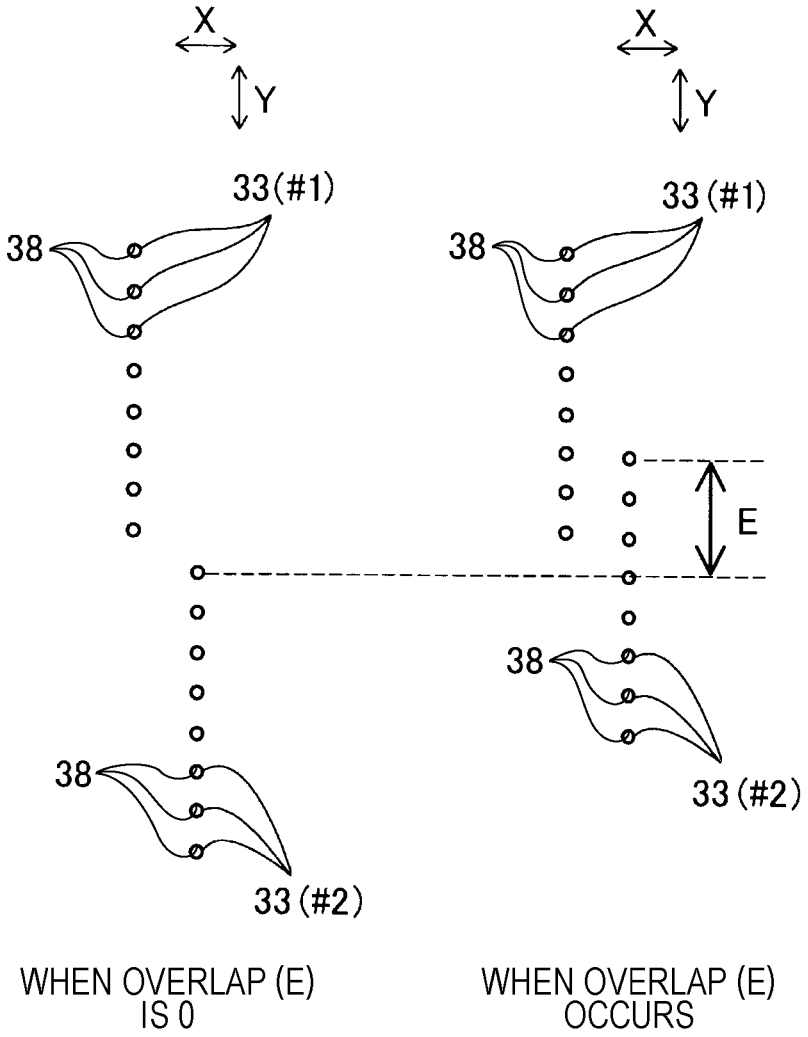
FIG. 5 is a diagram illustrating an overlapped amount of each recording head.

FIG. 5 is a diagram illustrating an overlapped amount of each of the recording heads 33. In the above-described condition a2, among the n pieces of recording heads 33, recording heads 33 included in the left-side head and recording heads 33 included in the right-side head are assumed to be disposed so as to have a predetermined overlapped amount E. As illustrated on the left side of FIG. 5, in a case where the overlapped amount E is 0, nozzles 38 disposed at the lowermost end in a recording head 33 (first head in the example of FIG. 5) which is included in the left-side head, and nozzles 38 disposed at the uppermost end in a recording head 33 (second head in the example of FIG. 5) which is included in the right-side head have a gap in the sub-scanning direction Y, which is assumed to be substantially the same as the nozzle pitch in the nozzle line 39.

As illustrated on the right side of FIG. 5, in a case where the overlapped amount E is 3, nozzles 38 disposed at the uppermost end in a recording head 33 (second head in the example of FIG. 5) which is included in the right-side head are assumed to be disposed so as to be shifted upwardly in the sub-scanning direction Y by (the nozzle pitch in the nozzle line 39)×2, in comparison to nozzles 38 disposed at the lowermost end in a recording head 33 (first head in the example of FIG. 5) which is included in the left-side head. Similarly, in a case of the third head and the fourth head, in a case of the fifth head and the sixth head, and the like, nozzles are disposed so as to have a predetermined overlapped amount E. The value of the overlapped amount E can be randomly set or changed in accordance with image quality and the like which are obtained in the printer 10.

Returning to FIG. 4, an operation when the recording unit 30 according to the embodiment forms a dot will be described. The printer 10 performs "the main scanning" in which the recording unit 30 forms a dot on a sheet 13 with moving in the main scanning direction X, M times. Thus, formation of dots on one print area of the sheet 13 is finished. The first main scanning is also referred to as "a first path". The value of M can be randomly set or changed in accordance with obtained print resolution. In the embodiment, M is set to 8 (that is, 8 paths printing). An operation of the recording unit 30 will be specifically described below.

Figure 2:
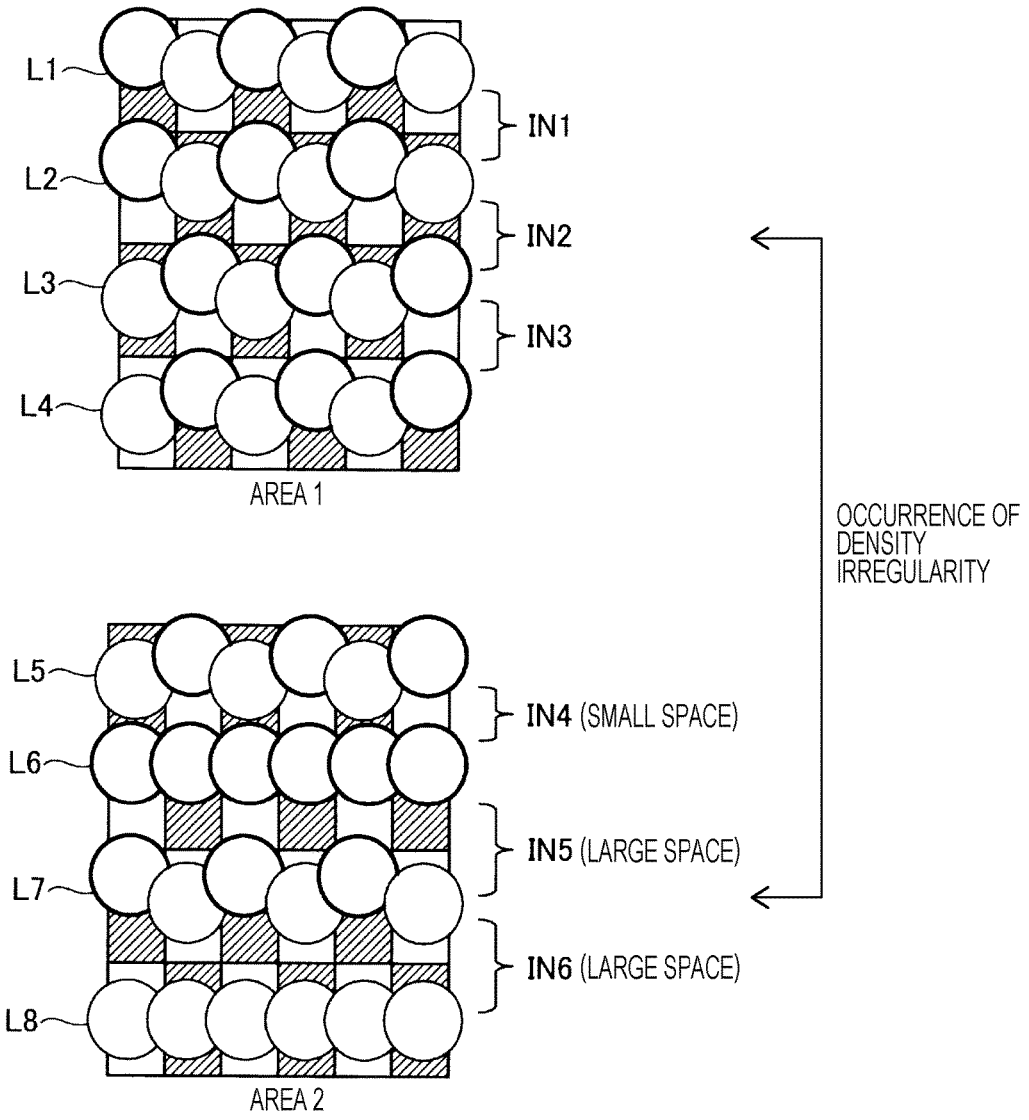
FIG. 2 is a diagram illustrating a problem of the related art.

Firstly, the recording unit 30 performs printing of the first path by forming dots with moving forth in the main scanning direction X. Then, the recording unit 30 performs "the sub-scanning" in which the recording unit 30 moves in the sub-scanning direction Y by a predetermined line-feed width Δy. The value of Δy can be randomly set or changed under a predetermined condition, in accordance with obtained print resolution. For example, the value of Δy may be changed in accordance with the number of print paths (value of M). Since printing of 8 paths is performed in the embodiment, Δy is set to a value of ¼ of the nozzle pitch. Then, the recording unit 30 performs printing of a second path by forming dots with moving back in the main scanning direction X. The printing of the first path and the second path causes one raster line to be formed on the sheet 13 (FIG. 2). "The raster line" means a dot line obtained by arranging dots in one line in the main scanning direction (that is, dot line in the main scanning direction). Since the sub-scanning is performed between the first path and the second path, adjacent dots (that is, a dot formed by forth moving and a dot formed by back moving) in the same raster line are formed by the nozzles 38 which are respectively disposed at different positions in the sub-scanning direction Y.

After one raster line is formed, the recording unit 30 moves in the sub-scanning direction Y by a predetermined line-feed width Δy. Thus, the recording unit 30 performs the third path in such a manner that the recording unit 30 forms dots again from a position after the sub-scanning, with moving in the main scanning direction X. The recording unit 30 moves in the sub-scanning direction Y by a predetermined line-feed width Δy. Thus, the recording unit 30 performs the fourth path in such a manner that the recording unit 30 forms dots again from a position after the sub-scanning, with moving in the main scanning direction X. The printing of the third path and the fourth path causes the next raster lines (different from those obtained when the first path and the second path) to be formed on the sheet 13. Then, the recording unit 30 moves in the sub-scanning direction Y by a predetermined line-feed width Δy. The recording unit 30 repeats to perform the main scanning and the sub-scanning, and thus printing up to the eighth path is performed. After printing up to the eight path is performed, the controller 50 performs the absorption-release operation, the transporting operation, and the absorption operation, and the print area on the sheet 13 is changed from the one print area to the next print area.

In a case where the printer 10 performs printing for a plurality of editions, the following operations may be repeatedly performed, the controller 50 may perform the absorption-release operation, the transporting operation, and the absorption operation, and then, the print area of the sheet 13 is changed. That is, the printing operation for the first to the eighth paths, which is used for causing the recording unit 30 to form a first edition, movement of returning a position of the recording unit 30 back to an initial position, an operation of performing the first to the eighth paths, which is used for causing the recording unit 30 to form a second edition, movement of returning a position of the recording unit 30 back to an initial position, . . . may be repeatedly performed. As an example of the printing of a plurality of editions, for example, two-edition printing, three-edition printing, and the like are provided. In the two-edition printing, an edition for the original image, and an edition for an overcoat layer are overlapped with each other so as to perform printing. In the three-edition printing, an edition for a undercoat layer, an edition for the original image, and an edition for an overcoat layer are overlapped with each other so as to perform printing.

A-4. Full-Overlap Processing

Figure 6:
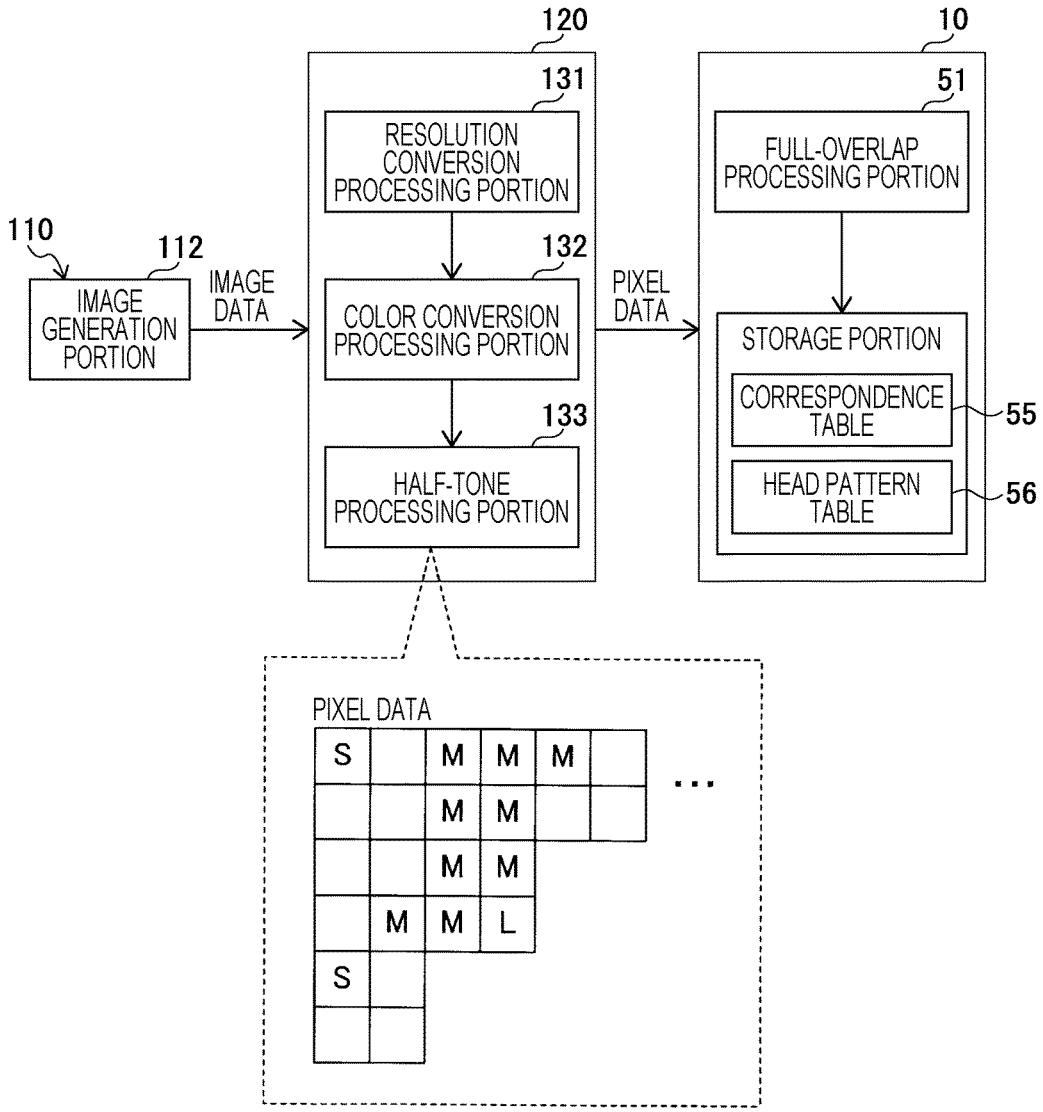
FIG. 6 is a functional block diagram illustrating the configuration of the printing system.

FIG. 6 is a functional block diagram illustrating a configuration of a printing system 100. As illustrated in FIG. 3, image data is generated by the image generation portion 112 of the image generation device 110. The resolution conversion processing portion 131 of the host device 120 converts resolution of the image data from display resolution into print resolution. The color conversion processing portion 132 performs color conversion on the image data. The half-tone processing portion 133 performs gradation conversion on the image data into pixel data having low gradation for printing. In FIG. 6, pixel data subjected to gradation conversion by the half-tone processing portion 133 is illustrated with a bubble of a broken line. One rectangular frame in the pixel data corresponds to one pixel. As illustrated in FIG. 6, the pixel data stores information which separately indicates no formation (blank) of a dot, formation (S) of a small dot, formation (M) of a medium dot, and formation (L) of a large dot for each pixel.

The host device 120 transmits pixel data obtained after ending half-tone processing, to the printer 10. The full-overlap processing portion 51 of the printer 10 determines the number of the head in the recording unit 30, a nozzle 38 for discharging an ink, and an amount of the ink discharged from the nozzle 38 when each pixel in the pixel data is formed by discharging the ink, based on the received pixel data, the correspondence table 55 and the head pattern table 56 which are stored in the storage portion in advance.

FIG. 7 is a diagram illustrating an example of the correspondence table 55. The correspondence table 55 is a table in which a correspondence relationship (also below referred to as "a use head pattern") between the number of paths for forming dots and a use head is stored in correlation with each area in the print area. The correspondence table 55 includes a distance from an upper end of a print region, and a use head number.

The "distance from the upper end of a print region" is information used for dividing the print area into a plurality of areas and for defining each of the areas. Here, the area means a portion of a print area configured by a plurality of raster lines. Specifically, regarding the distance from the upper end of the print region, a start position (start in FIG. 7) and an end position (end in FIG. 7) of each of the areas are defined for the distance (mm) from the upper end of the print region. In the example in FIG. 7, for example, a space in which the distance from the upper end of the print region is from 0.00 mm to 6.21 mm is defined as an area A1. A space in which the distance from the upper end of the print region is from 6.21 mm to 12.42 mm is defined as an area A2.

The "use head number" is information used for referring to a recording head 33 of the recording unit 30, which is to be used in each of the first to the eighth paths for the main scanning, in order to form a raster line (dots) included in each of the areas. Specifically, the head number (#1 to #8) of the recording head 33 is defined in each of the paths from the first path to the eighth path, for each of the areas distinguished in accordance with the distance from the upper end of the print region, in the use head number. In the example of FIG. 7, regarding the area A1, it is defined that the second head (#2) is used in the first path to the fourth path, and the first head (#1) is used in the fifth path to the eighth path. Regarding the area A2, it is defined that the third head (#3) is used in the first path, the second head (#2) is used in the second path to the fifth path, and the first head (#1) is used in the sixth path to the eighth path.

Figure 8:
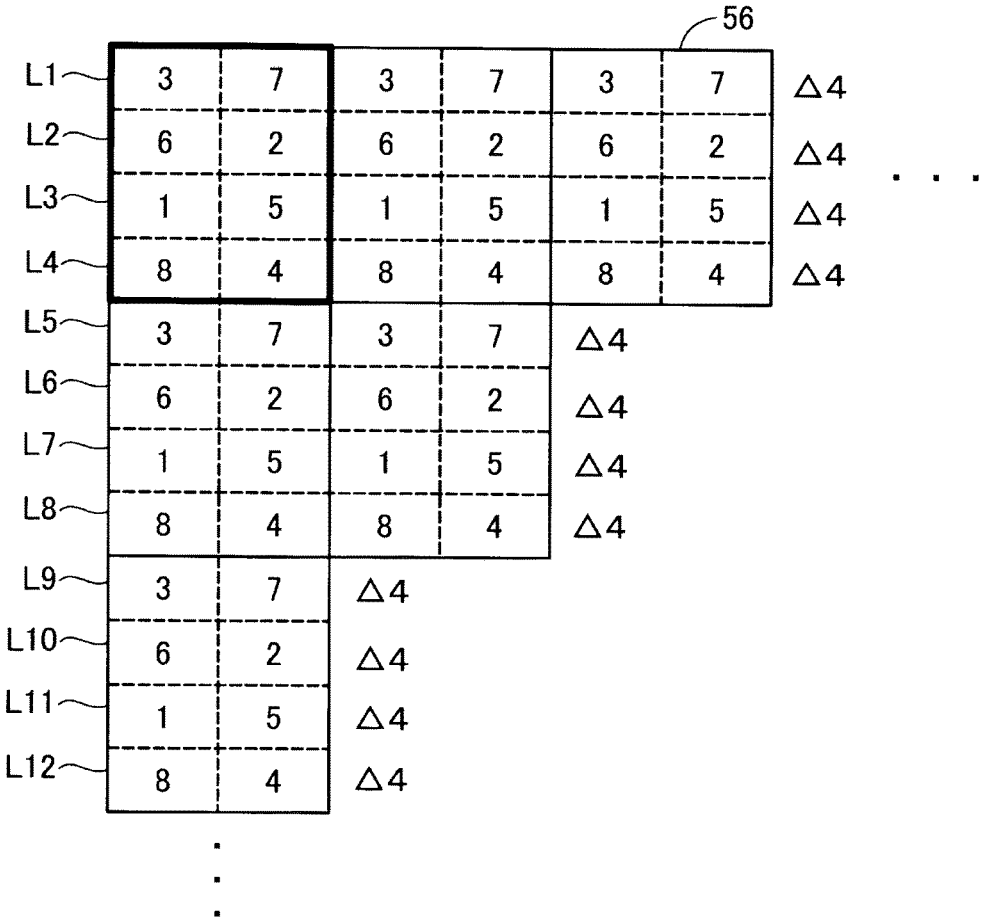
FIG. 8 is a diagram illustrating an example of a head pattern table.

FIG. 8 is a diagram illustrating an example of the head pattern table 56. The head pattern table 56 is a table in which the number of the path for the main scanning, which is used when each dot in each raster line is formed is stored. In the head pattern table 56, a line indicates a raster line and a row indicates a pixel in which one dot is formed. That is, the head pattern table 56 defines a dot formation order (which path) on each raster line included in each of the areas, which is defined by the correspondence table 55. In the example of FIG. 8, for example, regarding the first raster line L1, it is defined that the first, third, and fifth dots are formed by the third path, and the second, fourth, and sixth dots are formed by the seventh path. Regarding the next raster line L2, it is defined that the first, third, and fifth dots are formed by the sixth path, and the second, fourth, and sixth dots are formed by the second path.

In the head pattern table 56 in the embodiment, adjacent dots in the same raster line are defined so as to be formed at a path gap (gap of the main scanning) k based on the following Expression 1.

Total number of times(printing path number $M$) of performing the main scanning per print area in which the path gap $k=1$ is satisfied/number $n$ of recording heads 33 disposed in the main scanning direction $X$ (Expression1)

In the example in the embodiment, the total number (printing path number M) of performing the main scanning per one print area is 8, and the number n of recording heads 33 which are disposed in the main scanning direction X is 2. Thus, in the head pattern table 56, all of the adjacent dots in the same raster line are defined so as to be formed at the path gap k of 4 (Δ4 in FIG. 8). FIG. 8 is just an example. The dot formation order in the head pattern table 56 may be randomly changed as long as the path gap k between the adjacent dots in the same raster line satisfies the above-described Expression 1.

FIG. 9 is a diagram illustrating an example of the use head regarding the area A2 (space in which the distance from the upper end of the print region is from 6.21 mm to 12.42 mm) determined by the full-overlap processing portion 51. The full-overlap processing portion 51 in the embodiment determines the use head of the recording unit 30 based on the correspondence table 55 and the head pattern table 56 which are described above, by the following processes b1 to b4.

(b1) The full-overlap processing portion 51 acquires the use head pattern of an area which is a processing target, with reference to the correspondence table 55. In the example (area of the processing target: area A2) in FIG. 7, the full-overlap processing portion 51 acquires the use head pattern, that is, the third head (#3) for the first path, the second head (#2) for the second path to the fifth path, and the first head (#1) for the sixth path to the eighth path (FIG. 7).

(b2) The full-overlap processing portion 51 acquires the formation order of each dot in each raster line included in the area of the processing target, with reference to the head pattern table 56. In the example in FIG. 8, for example, the full-overlap processing portion 51 acquires the dot formation order in which regarding the raster line L1, the first, third, and fifth dots are formed in the third path, and the second, fourth, and sixth dots are formed in the seventh path (FIG. 8).

(b3) The full-overlap processing portion 51 determines the use head number which is used when each dot in each raster line included in the area of the processing target is formed, based on pieces of information which have been acquired by the procedures b1 and b2. In the example (area of the processing target: area A2) in FIG. 9, for example, the full-overlap processing portion 51 determines that, since regarding the raster line L1, the first, third, and fifth dots correspond to the third path, the first, third, and fifth dots are formed by using the second head (#2), and since the second, fourth, and sixth dots correspond to the seventh path, the second, fourth, and sixth dots are formed by the first head (#1).

(b4) The full-overlap processing portion 51 performs the above-described processes b1 to b3 for all areas in the print area. Thus, the full-overlap processing portion 51 can determines the use head number used when each dot in each raster line included in each of the areas is formed, regarding all of the areas in the print area.

Figure 10:
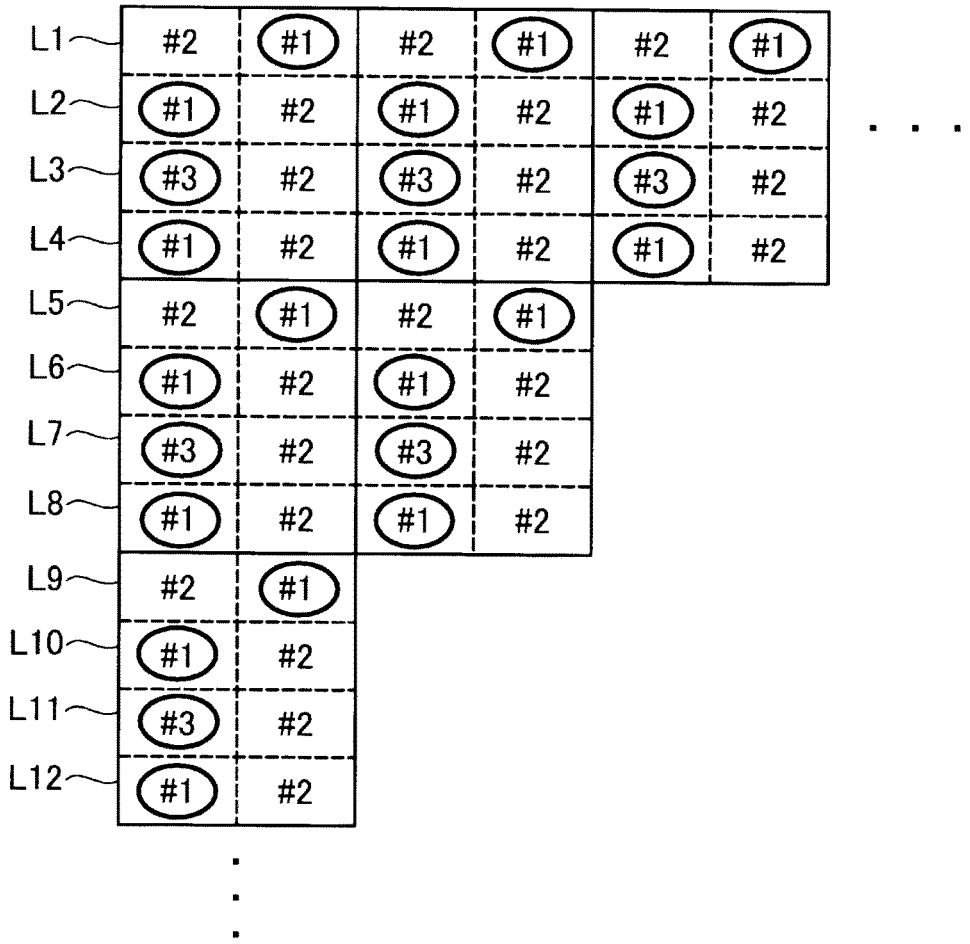
FIG. 10 is a diagram illustrating advantages of the embodiment.

FIG. 10 is a diagram illustrating advantages of the embodiment. In FIG. 10, regarding an example (FIG. 9) of the use head for the area A2 determined by the full-overlap processing portion 51, dots formed by the left-side head are indicated by being surrounded by circles, and dots formed by the right-side head are indicated by no circle. As apparent from FIG. 10, according to the full-overlap processing portion 51 in the embodiment, dots (including a circle) formed by using the left-side head and dots (no circle) formed by using the right-side head are necessarily mixed in each raster line. That is, according to the full-overlap processing portion 51 in the embodiment, all raster lines formed by the printer 10 correspond to the first type of raster line (FIG. 2, the top) in which both of dots formed by the nozzles of the right-side head, and dots formed by the nozzles of the left-side head are included. In all of the raster lines, the second type of raster line (FIG. 2, the bottom) in which only dots formed by the nozzles of either of the right-side head and the left-side head are included is not included. In other words, according to the full-overlap processing portion 51 in the embodiment, all of the raster lines formed by the printer 10 is formed by respectively using n pieces (two) of recording heads 33 which are arranged in the recording unit 30 in the main scanning direction X. FIGS. 9 and 10 illustrate the area A2. However, similar advantages are obtained for other areas in the correspondence table 55.

Figure 1:
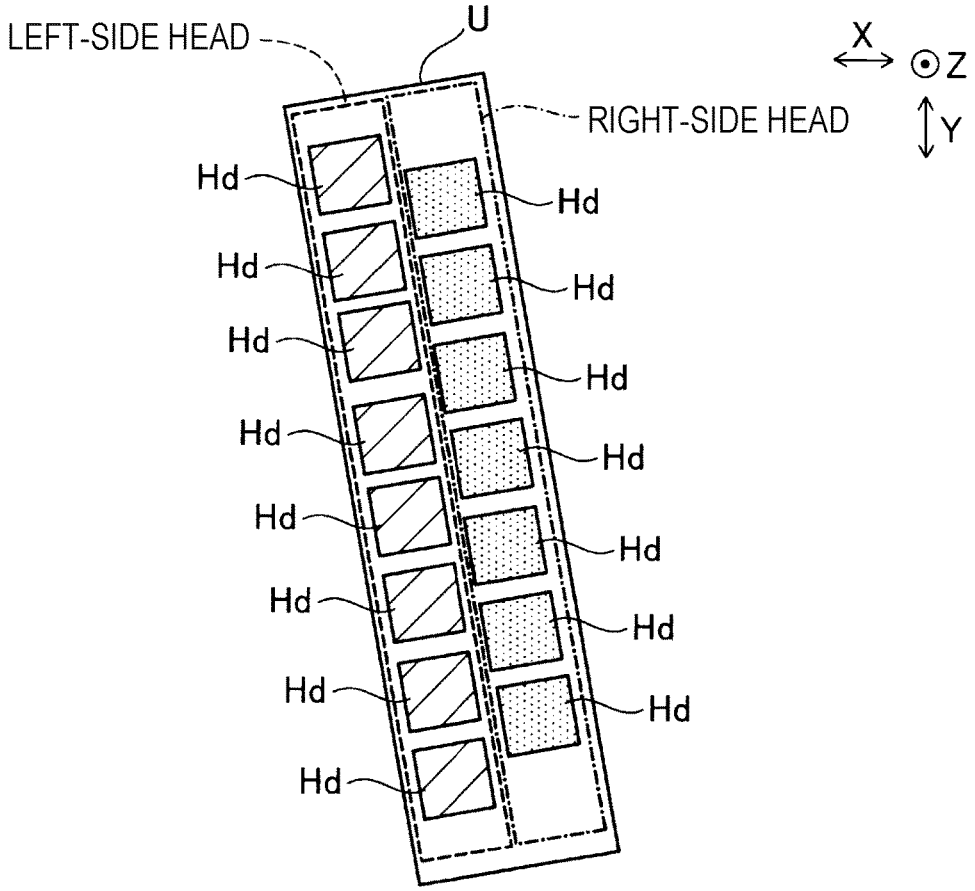
FIG. 1 is a diagram illustrating an example of a recording unit in which a plurality of recording heads is disposed in zigzag.

Thus, according to the printing system 100 in the embodiment, as illustrated in FIG. 1, even in a case where the recording unit 30 of the printer 10 is inclined from the sub-scanning direction Y by using a rotation shaft parallel to the depth direction Z, as the center (that is, in a case where the nozzle lines 39 of the recording head 33 are in a state of not being parallel to the sub-scanning direction Y), the second type of raster line is not included in raster lines formed by the printer 10, and thus, the banding unevenness as illustrated at the bottom in FIG. 2 does not occur on the sheet 13. As a result, according to the printing system 100 in the embodiment, it is possible to suppress the occurrence of the banding unevenness in the recording apparatus (printer 10, host device 120) in which printing is performed by the full-overlap method, and by using the recording unit 30 in which a plurality of recording heads 33 is disposed in zigzag.

Further, according to the printing system 100 in the embodiment, the above-described Expression 1 is used, and thus it is possible to simply determine the path gap k (gap between adjacent dots formed in the same raster line) in the head pattern table 56 used in the overlapping processing.

A-5. Comparative Example

A comparative example will be described below. A printer in the comparative example has a configuration which is similar to the printer 10 in the embodiment, except for a point that a head pattern table 56*x* illustrated in FIG. 11 is included instead of the head pattern table 56 illustrated in FIG. 8.

Figure 11:
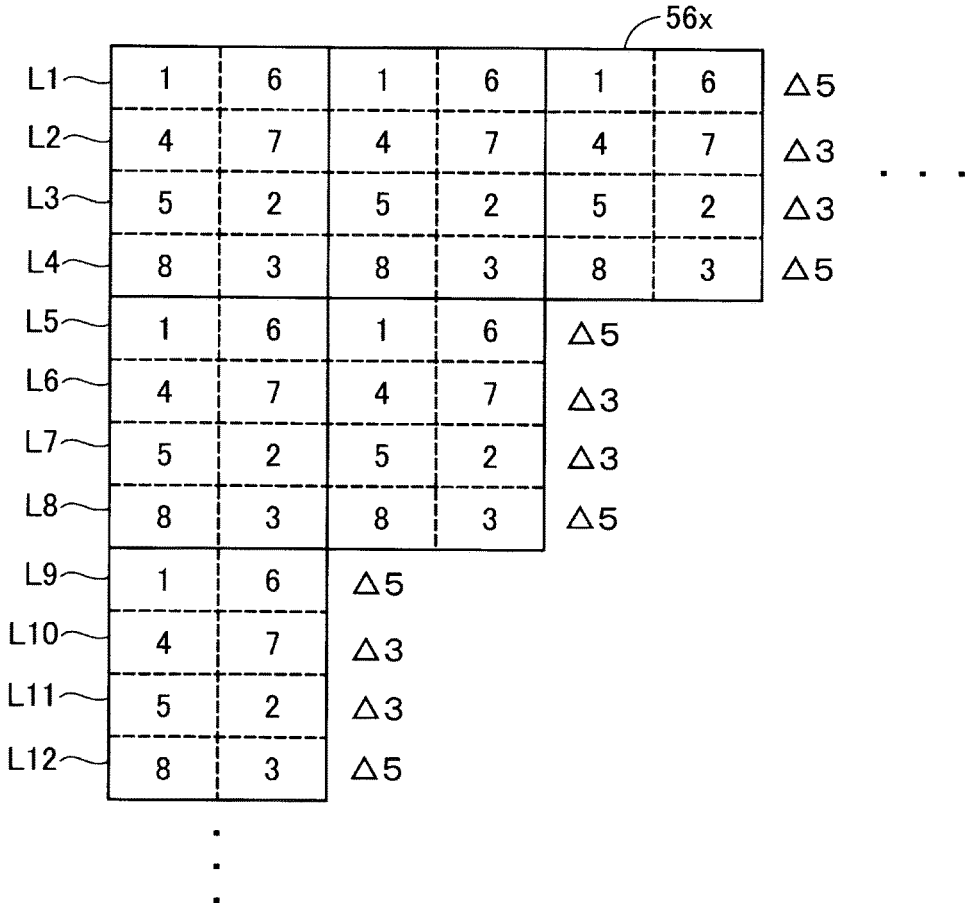
FIG. 11 is a diagram illustrating an example of a head pattern table in a comparative example.
Figure 12:
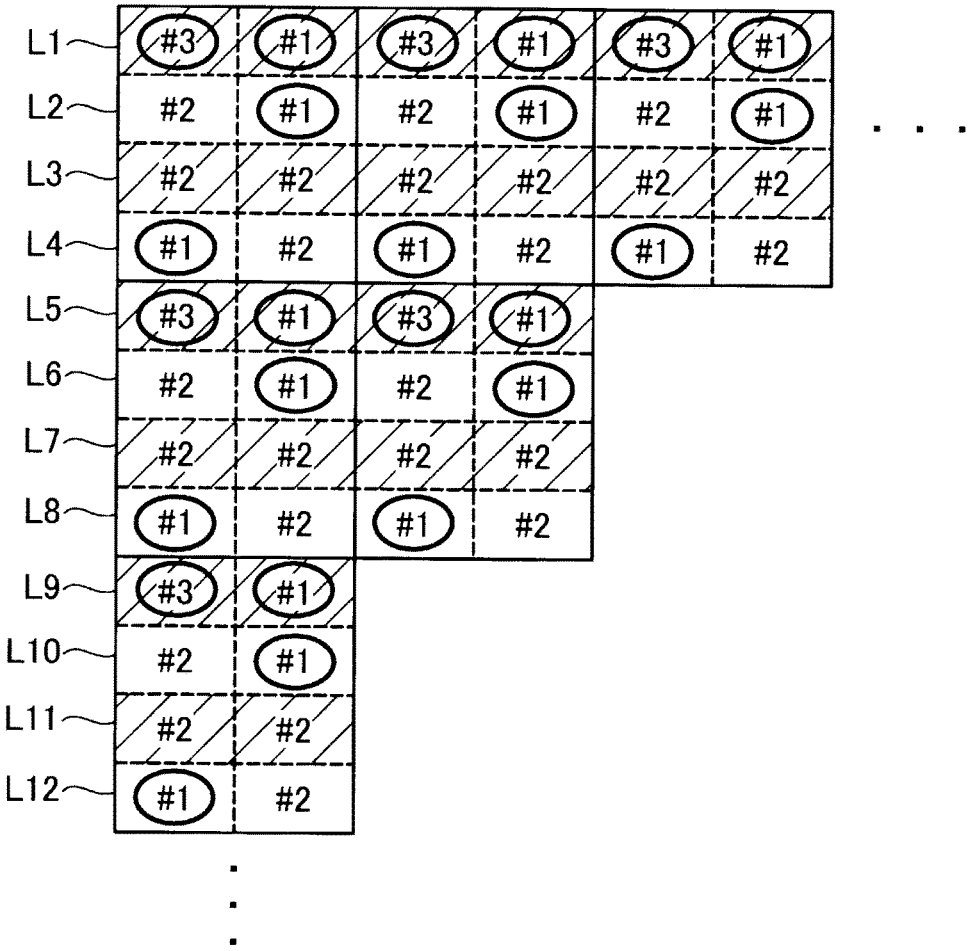
FIG. 12 is a diagram illustrating an example of use heads in an area determined by using the head pattern table in the comparative example.

FIG. 11 is a diagram illustrating an example of the head pattern table 56*x* in the comparative example. FIG. 12 is a diagram illustrating an example of a use head for an area A2 (space in which the distance from the upper end of a print region is from 6.21 mm to 12.42 mm) determined by using the head pattern table 56*x* in the comparative example. In the head pattern table 56*x* in the comparative example, adjacent dots in the same raster line do not satisfy the relationship of the above-described Expression 1. Specifically, in the head pattern table 56*x*, the path gap k is set to any one of 5 and 3 (Δ5 or Δ3 in FIG. 11). In FIG. 12, similar to FIG. 10, dots formed by the left-side head are indicated by being surrounded by circles, and dots formed by the right-side head are indicated by no circle.

As apparent from FIG. 12, according to a full-overlap processing portion in the comparative example, the second type of raster line (L1, L5, and L9 which are slash-hatched in FIG. 12) in which only dots formed by the nozzles of the left-side head, and the second type of raster line (L3, L7, and L11 which are slash-hatched in FIG. 12) in which only dots formed by the nozzles of the right-side head are included in raster lines. Thus, according to a full-overlap processing portion in the comparative example, as illustrated in FIG. 1, in a case where the recording unit of the printer is inclined by using the depth direction Z as the center, the banding unevenness as illustrated at the bottom in FIG. 2 occurs on the sheet 13. Thus, image quality of a printed matter is deteriorated.

A-6. Variations for Recording Head Disposition, Print Condition, and the Like The recording head disposition or the print condition which is described in the above embodiment is just an example. The invention can be employed as various forms. For example, variation mentioned as follows can be employed.

(1) Variation 1:

Disposition of the recording heads 33 in the printing system 100 according to Variation 1 is similar to that in FIG. 4. Print conditions in the printing system 100 according to Variation 1 are as follows.

Number (condition a1) of recording heads 33 in the main scanning direction X: n=2

Nozzle resolution (number of nozzles 38 included in one recording head 33): 180

Overlapped amount of each of the recording heads 33: E=4

Total number (printing path number) of times of performing the main scanning per one print area: M=8 paths.

Smallest lattice size: 2 pixels in the main scanning direction X, 4 pixels in the sub-scanning direction Y Print resolution: 1440 dpi in the main scanning direction X, 720 dpi in the sub-scanning direction Y Line-feed width Δy: 179/720 inches Settable minimum value of line-feed width Δy: 176/720 inches Settable maximum value of line-feed width Δy: 180/720 inches (¼ of the length of the recording head 33)

The smallest lattice size corresponds to the minimum (bold frame in FIG. 8) of a set of dots formed by the total number (that is, printing path number) of times of performing the main scanning in the main scanning direction X and the sub-scanning direction Y, in the head pattern table 56.

The path gap k of the head pattern table 56 in a case of Variation 1 is obtained as follows by using Expression 1.

Path gap *k*:(printing path number *M*/number *n* of recording heads 33 in the main scanning direction *X*)=(8/2)=4

Thus, it is defined in the head pattern table 56 that all adjacent dots in the same raster line are formed at the path gap k of 4. If the above definition is applied, it is possible to obtain advantages which are similar to in the embodiment, in the configuration of Variation 1.

(2) Variation 2:

Disposition of the recording heads 33 in the printing system 100 according to Variation 2 is similar to that in FIG. 4. Print conditions in the printing system 100 according to Variation 2 are as follows.

Number (condition a1) of recording heads 33 in the main scanning direction X: n=2

Nozzle resolution (number of nozzles 38 included in one recording head 33): 180

Overlapped amount of each of the recording heads 33: E=4

Total number (printing path number) of times of performing the main scanning per one print area: M=8 paths.

Smallest lattice size: 2 pixels in the main scanning direction X, 4 pixels in the sub-scanning direction Y Print resolution: 1440 dpi in the main scanning direction X, 720 dpi in the sub-scanning direction Y Line-feed width Δy: random value between the following minimum value and the following maximum value Settable minimum value of line-feed width Δy: 176/720 inches Settable maximum value of line-feed width Δy: 180/720 inches (¼ of the length of the recording head 33)

The path gap k of the head pattern table 56 in a case of Variation 2 is obtained as follows by using Expression 1.

Path gap *k*:(printing path number *M*/number *n* of recording heads 33 in the main scanning direction *X*)=(8/2)=4

Thus, it is defined in the head pattern table 56 that all adjacent dots in the same raster line are formed at the path gap k of 4. If the above definition is applied, it is possible to obtain advantages which are similar to in the embodiment, in the configuration of Variation 2.

(3) Variation 3:

Disposition of the recording heads 33 in the printing system 100 according to Variation 3 is similar to that in FIG. 4. Print conditions in the printing system 100 according to Variation 3 are as follows.

Number (condition a1) of recording heads 33 in the main scanning direction X: n=2

Nozzle resolution (number of nozzles 38 included in one recording head 33): 180

Overlapped amount of each of the recording heads 33: E=4

Total number (printing path number) of times of performing the main scanning per one print area: M=4 paths.

Smallest lattice size: 2 pixels in the main scanning direction X, 2 pixels in the sub-scanning direction Y Print resolution: 720 dpi in the main scanning direction X, 360 dpi in the sub-scanning direction Y Line-feed width Δy: 179/360 inches Settable minimum value of line-feed width Δy: 176/360 inches Settable maximum value of line-feed width Δy: 180/360 inches (½ of the length of the recording head 33)

The path gap k of the head pattern table 56 in a case of Variation 3 is obtained as follows by using Expression 1.

Path gap *k*:(printing path number *M*/number *n* of recording heads 33 in the main scanning direction *X*)=(4/2)=2

Thus, it is defined in the head pattern table 56 that all adjacent dots in the same raster line are formed at the path gap k of 2. If the above definition is applied, it is possible to obtain advantages which are similar to in the embodiment, in the configuration of Variation 3.

Figure 13:
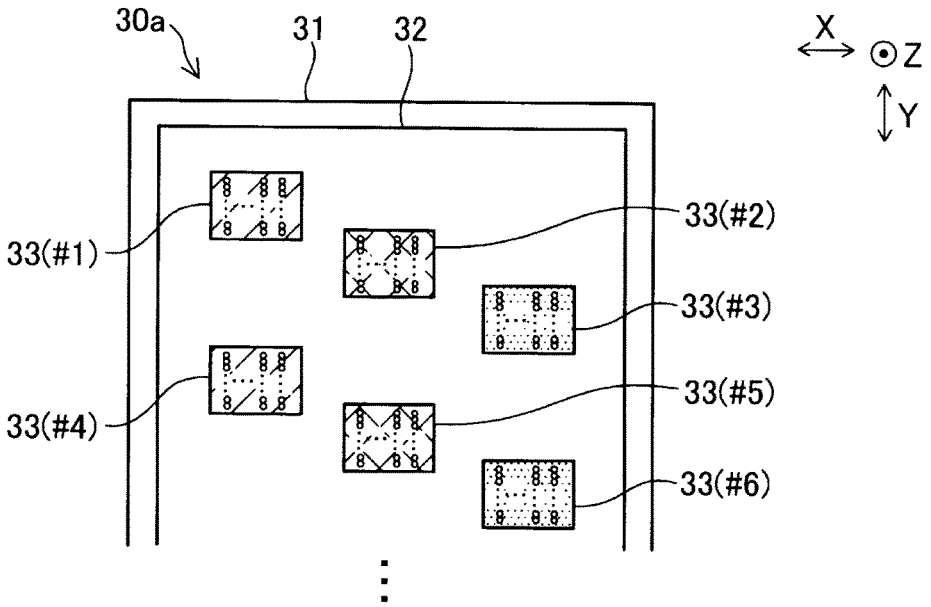
FIG. 13 is a diagram illustrating a configuration of a recording unit as a variation.

(4) Variation 4:

FIG. 13 is a diagram illustrating a configuration of a recording unit 30*a* in Variation 4. The printing system 100 in Variation 4 includes a recording unit 30*a* instead of the recording unit 30. The recording unit 30*a* has a configuration which is similar to the recording unit 30 illustrated in FIG. 4, except for a point (condition a1) that three recording heads 33 are disposed in the main scanning direction X. In FIG. 13, the nozzle lines 39 are not illustrated. Print conditions in the printing system 100 according to Variation 4 are as follows.

Number (condition a1) of recording heads 33 in the main scanning direction X: n=3

Nozzle resolution (number of nozzles 38 included in one recording head 33): 180

Overlapped amount of each of the recording heads 33: E=4

Total number (printing path number) of times of performing the main scanning per one print area: M=6 paths.

Smallest lattice size: 3 pixels in the main scanning direction X, 2 pixels in the sub-scanning direction Y Print resolution: 1080 dpi in the main scanning direction X, 360 dpi in the sub-scanning direction Y Line-feed width Δy: 177/360 inches Settable minimum value of line-feed width Δy: 176/360 inches Settable maximum value of line-feed width Δy: 180/360 inches The path gap k of the head pattern table 56 in a case of Variation 4 is obtained as follows by using Expression 1.

Path gap *k*:(printing path number *M*/number *n* of recording heads 33 in the main scanning direction *X*)=(6/3)=2

Thus, it is defined in the head pattern table 56 that all adjacent dots in the same raster line are formed at the path gap k of 2. If the above definition is applied, it is possible to obtain advantages which are similar to in the embodiment, in the configuration of Variation 4.

Figure 14:
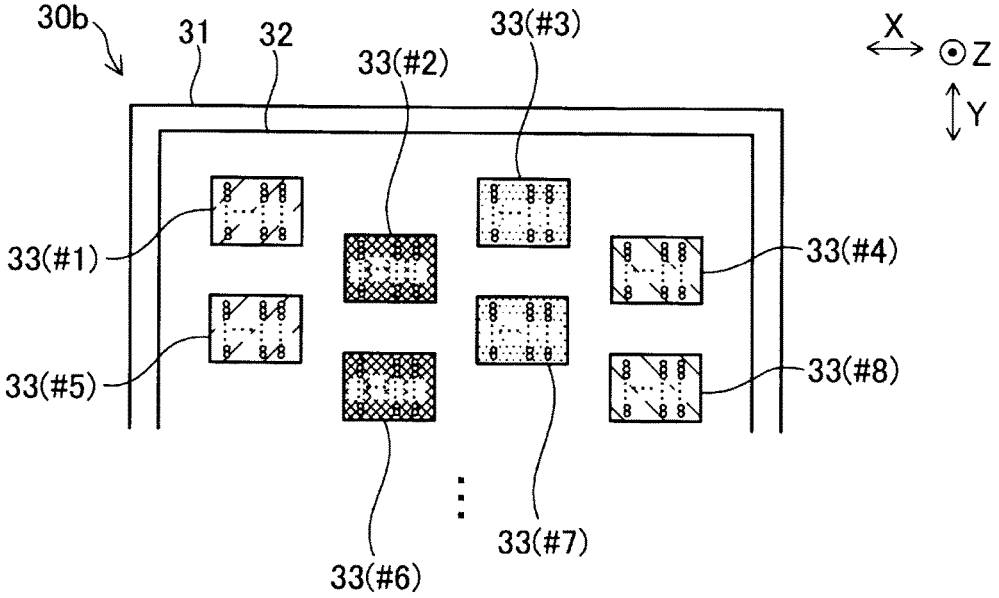
FIG. 14 is a diagram illustrating a configuration of a recording unit as a variation.

(5) Variation 5:

FIG. 14 is a diagram illustrating a configuration of a recording unit 30*b* in Variation 5. The printing system 100 in Variation 5 includes a recording unit 30*b* instead of the recording unit 30. The recording unit 30*b* has a configuration which is similar to the recording unit 30 illustrated in FIG. 4, except for a point (condition a1) that four recording heads 33 are disposed in the main scanning direction X. It is assumed that the first head (#1 in FIG. 14) and the third head (#3 in FIG. 14) have the same position in the sub-scanning direction Y in the recording unit 30*b*. Specifically, the two recording heads 33 (#1 and #3) have the same positions of nozzles 38 in the sub-scanning direction Y. It is assumed that the second head (#2 in FIG. 14) and the fourth head (#4 in FIG. 14) also have the same position in the sub-scanning direction Y in the recording unit 30*b*. In such a recording unit 30*b*, any of the recording heads 33 has the same position in the sub-scanning direction Y. However, it is assumed that the above-described condition a2 is satisfied in such a case. That is, regarding the condition a2, disposition of recording heads 33 of which the positions in the sub-scanning direction Y are the same, and the positions in the main scanning direction X are different is allowed. In FIG. 14, the nozzle lines 39 are not illustrated. Print conditions in the printing system 100 according to Variation 5 are as follows.

Number (condition a1) of recording heads 33 in the main scanning direction X: n=4

Nozzle resolution (number of nozzles 38 included in one recording head 33): 180

Overlapped amount of each of the recording heads 33: E=4

Total number (printing path number) of times of performing the main scanning per one print area: M=8 paths Smallest lattice size: 4 pixels in the main scanning direction X, 2 pixels in the sub-scanning direction Y Print resolution: 2880 dpi in the main scanning direction X, 360 dpi in the sub-scanning direction Y Line-feed width Δy: 89/360 inches Settable minimum value of line-feed width Δy: 88/360 inches Settable maximum value of line-feed width Δy: 90/360 inches The path gap k of the head pattern table 56 in a case of Variation 5 is obtained as follows by using Expression 1.

Path gap $k$:(printing path number $M$/number $n$ of recording heads 33 in the main scanning direction $X$)=(8/2)=4

Thus, it is defined in the head pattern table 56 that all adjacent dots in the same raster line are formed at the path gap k of 2. If the above definition is applied, it is possible to obtain advantages which are similar to in the embodiment, in the configuration of Variation 5. Further, the recording unit 30*b* in Variation 5 includes two recording heads 33 (#1 and #3, #2 and #4) of which positions in the sub-scanning direction Y are the same. Thus, the recording unit 30*b* causes the resolution in the main scanning direction X to be twice in comparison to the configuration of the above embodiment (FIG. 4) (printing resolution in the print condition: main scanning direction X=2880 dpi). As a result, according to the recording unit 30*b*, even in a case where a moving speed of the recording unit 30*b* (carriage speed) is fast, it is possible to suppress a reduction of the resolution in the main scanning direction X, in comparison to the configuration of the above embodiment (FIG. 4).

Figure 15:
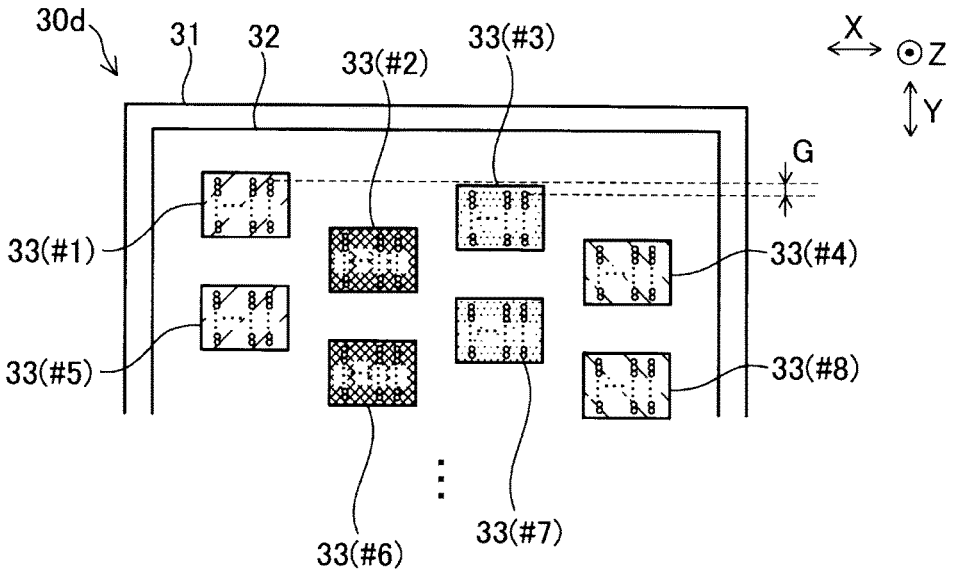
FIG. 15 is a diagram illustrating a configuration of a recording unit as a variation.

(6) Variation 6:

FIG. 15 is a diagram illustrating a configuration of a recording unit 30*d* in Variation 6. The printing system 100 in Variation 6 includes a recording unit 30*d* instead of the recording unit 30. The recording unit 30*d* has a configuration which is similar to the recording unit 30 illustrated in FIG. 4, except for a point (condition a1) that four recording heads 33 are disposed in the main scanning direction X. In the recording unit 30*d*, the first head (#1 in FIG. 15) and the third head (#3 in FIG. 15) are disposed so as to have positions which are shifted by a predetermined gap G in the sub-scanning direction Y. In this example, it is assumed that G is ½ nozzle pitch. However, in FIG. 15, for convenience of illustration, G is emphasized and indicated. Thus, in the recording unit 30*d* illustrated in FIG. 15, two recording heads 33 (#1 and #3) are disposed so as to cause the positions of the nozzles 38 in the sub-scanning direction Y to be shifted by ½ nozzle pitch. Similarly, the second head (#2 in FIG. 15) and the fourth head (#4 in FIG. 15) are also have positions which are shifted by ½ nozzle pitch in the sub-scanning direction Y. In FIG. 15, the nozzle lines 39 are not illustrated. Print conditions in the printing system 100 according to Variation 6 are as follows.

Number (condition a1) of recording heads 33 in the main scanning direction X: n=4

Nozzle resolution (number of nozzles 38 included in one recording head 33): 360

Overlapped amount of each of the recording heads 33: E=4

Total number (printing path number) of times of performing the main scanning per one print area: M=8 paths Smallest lattice size: 4 pixels in the main scanning direction X, 2 pixels in the sub-scanning direction Y Print resolution: 2880 dpi in the main scanning direction X, 720 dpi in the sub-scanning direction Y Line-feed width Δy: 177/720 inches Settable minimum value of line-feed width Δy: 176/720 inches Settable maximum value of line-feed width Δy: 180/720 inches The path gap k of the head pattern table 56 in a case of Variation 6 is obtained as follows by using Expression 1.

Path gap $k$:(printing path number $M$/number $n$ of recording heads 33 in the main scanning direction $X$)=(8/4)=2

Thus, it is defined in the head pattern table 56 that all adjacent dots in the same raster line are formed at the path gap k of 2. If the above definition is applied, it is possible to obtain advantages which are similar to in the embodiment, in the configuration of Variation 6. Further, the recording unit 30*d* in Variation 6 includes two recording heads 33 (#1 and #3, #2 and #4) of which positions are shifted by ½ nozzle pitch in the sub-scanning direction Y. Such two recording heads 33 which are shifted by ½ nozzle pitch can be simulatively considered as one recording head 33. For such a reason, it is considered that the nozzle resolution (number of nozzles 38 included in one recording head 33) of the above-described print condition is 360 (that is, 180×2). Thus, the recording unit 30*d* can cause the resolution in the main scanning direction X and the resolution in the sub-scanning direction Y to be twice in comparison to the configuration of the above embodiment (FIG. 4) (printing resolution in the print condition: main scanning direction X=2880 dpi, sub-scanning direction Y=720 dpi). As a result, according to the recording unit 30*d*, even in a case where a moving speed of the recording unit 30*d* (carriage speed) is fast, it is possible to suppress a reduction of the resolution in the main scanning direction X and the resolution in the sub-scanning direction Y, in comparison to the configuration of the above embodiment (FIG. 4).

B. Second Embodiment

In a second embodiment of the invention, a configuration in which two head pattern tables are separately used will be described. Only parts which have components and operations different from those in the first embodiment will be described below. Components similar to those in the first embodiment in the figure are denoted by reference signs which are similar to those in the aforementioned first embodiment, and detailed descriptions thereof will be omitted.

Figure 16:
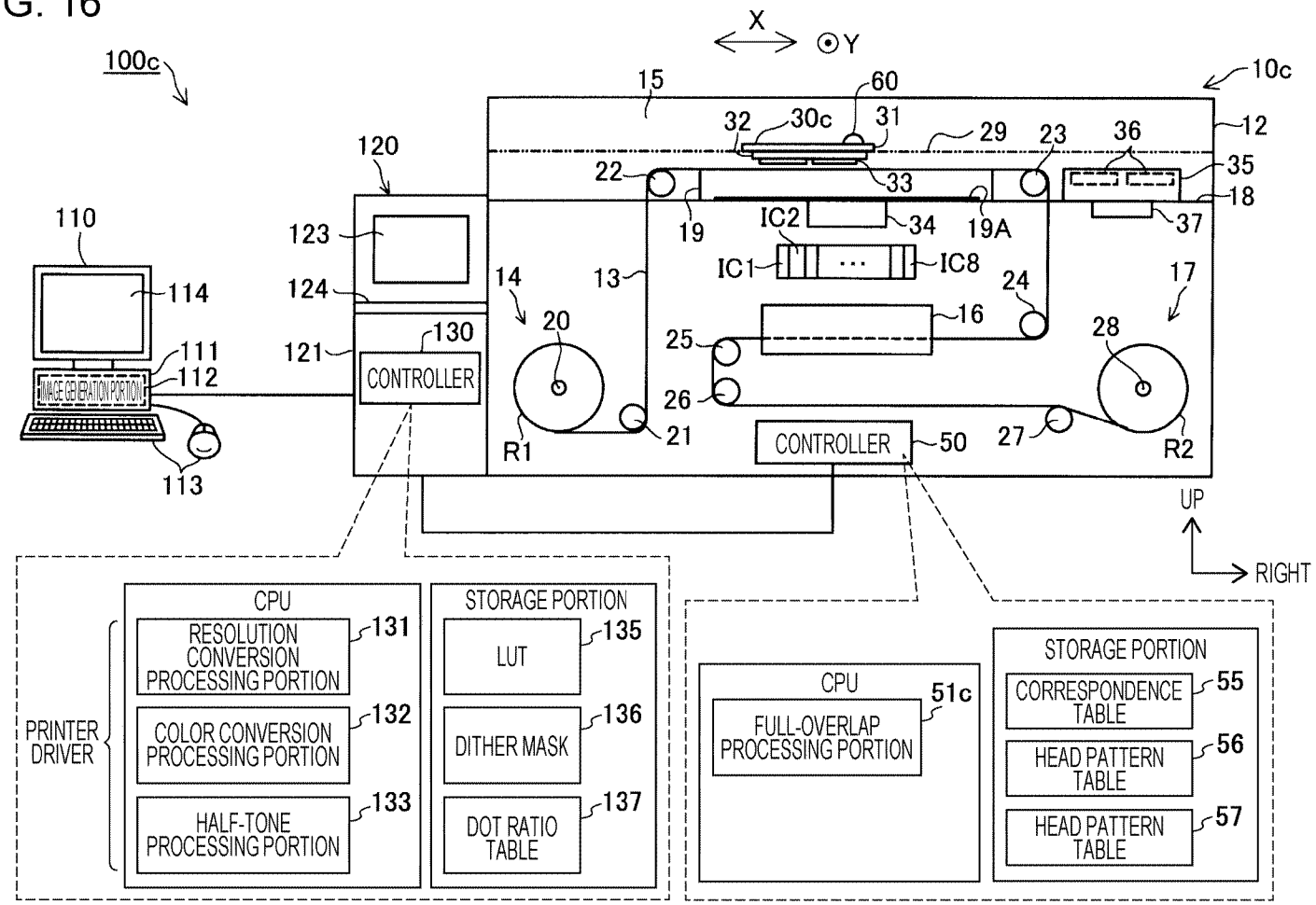
FIG. 16 is a schematic diagram illustrating a configuration of a printing system according to a second embodiment.

FIG. 16 is a schematic diagram illustrating a configuration of a printing system 100*c* according to the second embodiment. The second embodiment illustrated in FIG. 16 is different from the first embodiment illustrated in FIG. 3 in that the printer 10*c* is included instead of the printer 10. The printer 10*c* includes a recording unit 30*c* instead of the recording unit 30. The recording unit 30*c* further includes an inclination detector 60, in addition to the components illustrated in FIG. 4. The inclination detector 60 may be realized by, for example, an acceleration sensor, a magnetic sensor, and the like.

A storage portion of the printer 10*c* stores two head pattern tables (head pattern tables 56 and 57) in advance. The configuration of the head pattern table 56 is similar to that in the first embodiment illustrated in FIG. 8. The configuration of the head pattern table 57 is similar to that in the comparative example illustrated in FIG. 11.

Further, the printer 10*c* includes a full-overlap processing portion 51*c* instead of the full-overlap processing portion 51. The full-overlap processing portion 51*c* performs the full-overlap processing by using the head pattern table 57 which has a configuration similar to the comparative example, during a period until at least one of the following conditions c1 and c2 is detected. After at least one of the following conditions c1 and c2 is detected, the full-overlap processing portion 51*c* performs the full-overlap processing by using the head pattern table 56 which has a configuration similar to the first embodiment.

(c1) Case where the image generation device 110, the host device 120, or the printer 10*c* acquires a switching request from a user.

(c2) Case where the inclination detector 60 detects that the recording unit 30*c* is inclined from the sub-scanning direction Y (or the main scanning direction X) by using a rotation shaft which is parallel to the depth direction Z (FIGS. 1 and 4), as the center, and the angle of the inclination is equal to or more than a predetermined angle.

The predetermined angle may be randomly set or changed. The full-overlap processing portion 51*c* may switch a head pattern table used in the full-overlap processing from the head pattern table 56 to the head pattern table 57 again, in a case where the switching request by the condition c1 is acquired again, or in a case where the inclination of the recording unit 30*c* by the condition c2 is not detected.

According to the printing system 100*c* in the second embodiment, a pattern of the use head of the recording unit 30*c* can be separately used between the pattern illustrated in FIG. 12 and the pattern illustrated in FIG. 9, with using at least one of the switching request from a user, and the occurrence of inclination from the sub-scanning direction Y by using the rotation shaft which is parallel to the depth direction Z of the recording unit 30*c* (that is, case where the nozzle lines 39 of the recording head 33 is in a state of not being parallel to the sub-scanning direction Y) as motivations. Thus, as a result, convenience for a user is improved.

In the pattern of the use head illustrated in FIG. 9, n pieces (two) of recording heads 33 which are arranged in the main scanning direction X in the recording unit 30*c* are respectively used, and thus raster lines are formed. Thus, in the pattern of the use head illustrated in FIG. 9, as described above, there is an advantage in that it is possible to suppress the occurrence of the banding unevenness on a recording medium on which dots have been formed. In the pattern of the use head illustrated in FIG. 12, as illustrated in FIG. 2, a case where adjacent dots in the same raster line are formed by both of the left-side head and the right-side head, a case where adjacent dots in the same raster line are formed only by the left-side head, and a case where adjacent dots in the same raster line are formed only by the right-side head are mixed. Thus, in a case where the recording unit 30*c* is inclined from the sub-scanning direction Y, an influence of the banding unevenness is received in comparison to the pattern of the use head illustrated in FIG. 9. However, as understood from the head pattern table 56*x* illustrated in FIG. 11, since dots so as to be arranged in the sub-scanning direction Y are formed on both of the forward path and the backward path of the main scanning, and dots so as to be arranged in the main scanning direction X are formed on both of the forward path and the backward path of the main scanning, even when vibration occurs in the recording head 33 by back and forth movement of the recording unit 30*c*, it is possible to distribute formation positions of dots. Thus, there is an advantages in that occurrence of density unevenness may be suppressed in comparison to the pattern of the use head illustrated in FIG. 9. In the printing system 100*c* in the second embodiment, the pattern of the use head is separately used in accordance with the condition c1 or the condition c2, and thus it is possible to select the pattern of the use head which enables improvement of printed image quality in accordance with a situation.

C. Modification Example

In the embodiment, a portion of the configuration assumed to be realized by hardware may be replaced with software. Conversely, a portion of the configuration assumed to be realized by software may be replaced with hardware. In addition, the following modifications can be made.

Modification Example 1

In the embodiment, the configuration of the printing system is exemplified. However, the configuration of the printing system can be arbitrarily determined in a range without departing from the gist of the invention. For example, the components can be added, deleted, converted.

Allocation of components to the image generation device, the host device, and the printer in the embodiment is just an example, and various forms can be employed. For example, forms as follows may be made.

(1) Form in which some of the functions of the host device are mounted in the printer. In this case, the functions of the printer driver (resolution conversion processing portion, color conversion processing portion, and half-tone processing portion) and various types of information (LUT, dither mask, and dot ratio table) required for realizing the functions of the printer driver are all mounted in the printer.

(2) Form in which some of the functions of the printer are mounted in the host device. In this case, the function of the full-overlap processing portion and various types of information (correspondence table and head pattern table) required for realizing the function of the full-overlap processing portion are all mounted in the host device.

(3) Form in which the functions of the host device and the printer are duplicately mounted. In this case, the followings are in each of the host device and the printer.

Function of printer driver (resolution conversion processing portion, color conversion processing portion, and half-tone processing portion)

Various types of information (LUT, dither mask, and dot ratio table) required for realizing the functions of the printer driver Function of full-overlap processing portion Various types of information (correspondence table and head pattern table) required for realizing the functions of the full-overlap processing portion The printing system may switch a device in which each of resolution conversion processing, color conversion processing, half-tone processing, and full-overlap processing is performed, in accordance with a predetermined condition or a request from a user. Examples of the predetermined condition include data volume, print resolution, and the like. Specifically, for example, in a case where the data volume of image data is large (or a case where print resolution is low), the printing system can cause the host device to perform processing from the resolution conversion processing to half-tone processing, and cause the printer to perform the full-overlap processing. Generally, data volume of data after full-overlap processing is larger than the data volume of image data. Thus, if the host device performs the full-overlap processing in a case where the data volume of image data is large, communication load between the host device and the printer is increased. For example, in a case where the data volume of image data is small (or a case where print resolution is high), the printing system can cause the host device to perform all types of processing. Generally, the CPU of the host device has a processing speed excellent more than the CPU of the printer. Thus, in a case where the host device performs all types of processing, it is possible to reduce the total processing time.

Modification Example 2

In the embodiment, an example of the full-overlap processing is described. However, the procedures of the processing described in the embodiment are just an example. Various modifications can be made. For example, some steps may be omitted. Other steps may be further added. An order of performed steps may be changed.

In the full-overlap processing in the embodiment, the controller determines the use head, so as to set the path gap k which causes adjacent dots in the same raster line to satisfy the relationship of Expression 1, regarding all raster lines formed on a recording medium. However, the controller may determine the use head so as to set the path gap k which causes adjacent dots in the same raster line to satisfy the relationship of Expression 1, only in a case of some raster lines (for example, raster line formed by nozzles 38 disposed at the overlapped (superposed) portion illustrated in FIG. 5) formed on a recording medium.

Modification Example 3

The invention is not limited to the above-described embodiments, examples, and modification examples. The invention can be realized by various configurations in a range without departing from the gist. For example, technical features in the embodiments, the examples, and the modification examples which correspond to technical features in each of the aspects described in the field of the summary can be appropriately replaced or combined in order to solve a portion or the entirety of the above-described problem, or to achieve some of all of the above-described advantages. If the technical feature is not described as being necessary in the specification, the technical feature may be appropriately deleted.

This application claims priority under 35 U.S.C. §119 to Japanese Patent Application No. 2015-214556, filed Oct. 30 2015. The entire disclosure of Japanese Patent Application No. 2015-214556 is hereby incorporated herein by reference.

What is claimed is:

1. A recording apparatus which is a full-overlap type recording apparatus, the apparatus comprising:

a recording unit which includes n pieces (n is a natural number of 2 or more) of recording heads which enable forming of dots on a recording medium and are disposed in a main scanning direction of the recording unit, the n pieces of recording heads being disposed so as to have positions shifted from each other in a sub-scanning direction of the recording unit, and the n pieces of recording heads being disposed so as to form m sets (m is a natural number of 1 or more) in the sub-scanning direction;

a carriage that moves the recording units in the main scanning direction and the sub-scanning direction; and a controller that determines a use head based on image data, the use head being one of the recording heads, which is used for forming dots for one raster line on the recording medium, wherein the controller determines the use head for all raster lines formed on the recording medium, so as to respectively use the n pieces of recording heads when the raster lines are formed.

2. The recording apparatus according to claim 1, wherein the recording unit performs main scanning in which dots are formed on the recording medium with moving in the main scanning direction, on a print area M times (M is a natural number of 1 or more), the controller determines the use head so as to form dots which are adjacent to each other in each of the raster line by performing the main scanning for each of the number of times of k (k is natural number of 1 or more) which satisfies a relationship of k=M/n.

3. The recording apparatus according to claim 2, wherein in a case where a switching request is received from a user, the controller determines the use head so as to form dots which are adjacent to each other in each of the raster lines by performing the main scanning for each of the number of times of k which satisfies the relationship, and in a case where the switching request is not received from the user, the controller determines the use head without depending on the relationship.

4. The recording apparatus according to claim 2, further comprising:

an inclination detector that detects an inclination of the recording unit, wherein in a case where the inclination detector detects that the recording units are not parallel to the sub-scanning direction, the controller determines the use head so as to form dots which are adjacent to each other in each of the raster lines by performing the main scanning for each of the number of times of k which satisfies the relationship, and in a case where the inclination detector does not detect that the recording units are not parallel to the sub-scanning direction, the controller determines the use head without depending on the relationship.

5. The recording apparatus according to claim 1, wherein each of the recording heads includes a plurality of nozzles which form dots by discharging droplets, and are disposed parallel to each other in the sub-scanning direction, the n pieces of recording heads are disposed so as to overlap positions of some of the plurality of nozzles of the recording heads which are adjacent to each other, with each other in the sub-scanning direction, and the controller determines the use head so as to respectively use the n pieces of recording heads, when the droplets are discharged from the nozzles of the recording heads, which are disposed at a portion at which the overlap occurs.

6. A recording method of forming dots on a recording medium by using a full-overlap method and by using a recording apparatus which includes a recording unit and a carriage, the recording unit including n pieces (n is a natural number of 2 or more) of recording heads which enable forming of dots on a recording medium and are disposed in a main scanning direction of the recording unit, the n pieces of recording heads being disposed so as to have positions shifted from each other in a sub-scanning direction of the recording unit, and the n pieces of recording heads being disposed so as to form m sets (m is a natural number of 1 or more) in the sub-scanning direction, and the carriage moving the recording units in the main scanning direction and the sub-scanning direction, the method comprising:

determining a use head based on image data, the use head being one of the recording heads, which is used for forming dots for one raster line on the recording medium, wherein in the determining the use head, the use head is determined for all raster lines formed on the recording medium, so as to respectively use the n pieces of recording heads when all raster lines are formed.

* * * * *